US007069699B2

(12) United States Patent
Provitola

(10) Patent No.: US 7,069,699 B2
(45) Date of Patent: Jul. 4, 2006

(54) TOROIDAL FRAMEWORKS CONNECTION

(76) Inventor: Anthony Italo Provitola, P.O. Box 2855, DeLand, FL (US) 32721

( * ) Notice: Subject to any disclaimer, the term of this patent is extended or adjusted under 35 U.S.C. 154(b) by 0 days.

(21) Appl. No.: 10/368,838

(22) Filed: Feb. 19, 2003

(65) Prior Publication Data

US 2004/0159053 A1 Aug. 19, 2004

(51) Int. Cl.
*E40B 7/08* (2006.01)
*B25G 3/36* (2006.01)

(52) U.S. Cl. ..... 52/81.3; 403/398

(58) Field of Classification Search ..... 52/81.3, 52/655.1; 403/398; 24/339; 446/486, 368, 446/103, 104

See application file for complete search history.

(56) References Cited

U.S. PATENT DOCUMENTS 3,959,937 A * 6/1976 Spunt ..... 52/81.2
4,758,196 A * 7/1988 Wang ..... 446/104
5,049,104 A * 9/1991 Olsen ..... 446/104
5,383,715 A * 1/1995 Homma et al. ..... 301/5.23
5,538,484 A * 7/1996 Bell ..... 476/40
6,298,525 B1 * 10/2001 Margo ..... 24/336
6,325,694 B1 * 12/2001 Clever et al. ..... 446/104

FOREIGN PATENT DOCUMENTS

EP 489353 A1 * 6/1992

* cited by examiner

*Primary Examiner*—Peter M. Cuomo
*Assistant Examiner*—Sarah B. McPartlin

(57) ABSTRACT

The present invention is a connection for joining toroidal frameworks of toroidal elements. The connector includes one or more arms, each of which can span a toroidal framework to be joined, and each of which may be joined to one or more of the other arms, or to a conventional structure, directly or by an intermediating connector. Bach arm of the connector includes a base to which one or more lugs is attached to form projections from the side of the base. Each of the lugs has at least one surface that engages a toroidal element in order to transmit to the base a force which is applied directly to a toroidal element.

20 Claims, 21 Drawing Sheets

TOROIDAL FRAMEWORKS CONNECTION

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable

BACKGROUND OF THE INVENTION

The continuing development of the structural systems disclosed in U.S. Pat. Nos. 6,334,284 and 6,412,232 for the fabrication of low mass structural frameworks has demonstrated that in constructing a toroidal framework of toroidal elements a significant contribution to the mass of a toroidal framework of toroidal elements would be made by the use of the couplings described in those patents. Those couplings were designed to grasp a torsion element by surrounding a segment of the tube of such an element and locking with the tube or creating sufficient pressure within the coupling so as to fix the torsion element within the coupling so that torsional stress could be communicated between torsion elements by the coupling. Although such couplings, whether separate from the toroidal and torsion elements or integrated with such elements, are the best means for connecting the non-framework toroidal and torsion elements to form toroidal frameworks thereof, as progressively larger toroidal frameworks are built with toroidal frameworks that are constructed with progressively smaller toroidal frameworks, the necessity for connecting the frameworks to communicate torsional stress between them (and thus down to the smallest toroidal torsion elements in the structure) would require couplings whose mass was collectively so as to defeat the objective of large structural frameworks with low mass. Additionally, such couplings, because they must firmly grasp or lock to the elements they connect, would tend to restrict the potential for motion, and thus the degrees of freedom, of the toroidal elements in the toroidal framework they would connect. Therefore, the connection of toroidal torsion elements to create yet larger toroidal torsion frameworks of low mass requires that the collective contribution of mass from the means of connection be minimized in relation to the collective mass of all of the non-framework toroidal torsion elements. The present invention advances the development of low mass structures using the toroidal and torsional structural systems by providing a means for connecting toroidal and torsion frameworks which avoids the large size and mass of couplings which operate by surrounding parts of the tube of component toroidal frameworks.

The prior art that this invention builds upon is generally in the field of structures, particularly those disclosed in U.S. Pat. Nos. 6,334,284 and 6,412,232, and therefore under U.S. Class 52, particularly sub-classes 80.1, 81.1, 698, and 712, and Class 403, particularly subclasses 385, 389, and 396.

BRIEF SUMMARY OF THE INVENTION

The present invention is a connector for joining frameworks of torsion elements, frameworks of toroidal elements, and frameworks of toroidal torsion elements, and includes a system for joining such frameworks to form other structures and larger torsion, toroidal, and toroidal torsion frameworks. The connector may be used to connect all types of frameworks of toroidal elements.

The connector includes one or more arms, each of which can span a toroidal framework to be joined, and each of which may be joined to one or more of the other arms, or to a conventional structure, directly or by an intermediating connector. Each arm of the connector includes a base to which one or more lugs is attached to form projections from the side of the base. Each of the lugs has at least one surface that engages a toroidal element in order to transmit to the base a force which is applied directly to a toroidal element and to transmit to a toroidal element a force which is applied directly to a base. An arm, comprised of the base and lugs, forms a yoke about at least one toroidal element of a toroidal framework, which will transmit a torque to that toroidal framework about the tube described by the framework when a force is applied to the arm. A toroidal element may be a fundamental toroidal element, or a toroidal framework. A fundamental toroidal element is one which is not a toroidal framework. A system for connection of toroidal frameworks using the yoke-connector, and the process for the construction of multi-level toroidally shaped frameworks of toroidal elements using the yoke-connector, is also disclosed herein.

BRIEF DESCRIPTION OF THE DRAWINGS

FIG. 45 is an oblique view of a third-level toroidal framework formed by acute-angular connection of the second-level toroidal frameworks shown in.

FIG. 47 is an enlarged plan view of the outlined region shown in FIG. 46.

FIG. 48 an enlarged oblique view of the outlined region shown in FIG. 46.

DETAILED DESCRIPTION OF THE INVENTION

The present invention is a connection fix joining toroidal frameworks of acute-angularly connected toroidal elements and acute-angularly connected toroidal frameworks of toroidal torsion elements, such as those disclosed in U.S. Pat. Nos. 6,334,284 and 6,412,232, and includes a system for joining such frameworks to form other structures and larger toroidal and toroidal torsion frameworks. The connection may be used to connect all types of toroidal frameworks of acute-angularly connected toroidal elements disclosed by those United States Patents, and is particularly suited to the construction of toroidal torsion frameworks.

The connector includes one or more arms, each of which can span a toroidal framework to be joined, and each of which may be joined to one or more of the other arms, or to a conventional structure, directly or by an intermediating connector. The region where an arm is joined to another arm or to a conventional structure will hereinafter be referred to as the "joint region". Each arm of the connector includes a base to which one or more lugs is attached to form projections from the side of the base. A base may have any shape, the preferred shape being an elongated structurally rigid member, such as a rod, tube, or beam; however, the term "team" as used hereinafter shall be taken to include any such elongated structurally rigid member, including rods and tubes. Lugs may be fabricated as part of the base, or fabricated separately and attached by welding, by connectors such as bolts or screws, or by other mechanical means, such as a mechanical snap (a fastener comprised of two mated pieces, which, when forced together, trap each other so that the mated pieces are locked together). Each of the lugs has at least one surface that engages a toroidal element in order to transmit to the base a force which is applied directly to a toroidal element, and to transmit to a toroidal element a force which is applied directly to a base. A toroidal element may be a fundamental toroidal element, or a toroidal framework. A fundamental toroidal element is one which is not a toroidal framework, but may have other structural features, such as being solid, tubular, or an assembly. Both fundamental toroidal elements and toroidal frameworks are toroidal in shape.

To present the details of the connector, the function of its elements, and the method by which toroidal frameworks are connected using the connector, reference is made to the numerous drawings of the various embodiments of the connector.

Figure 1:
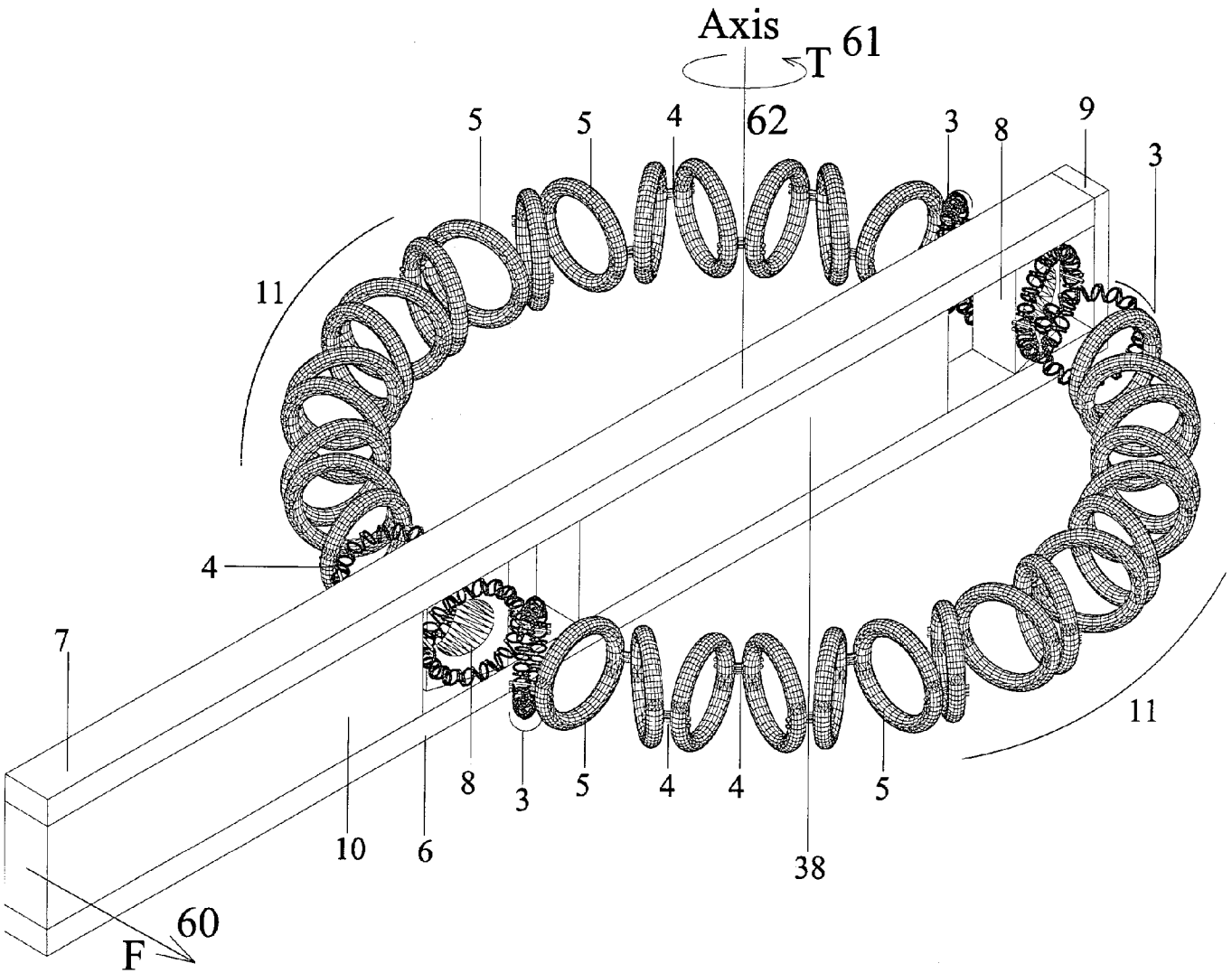
FIG. 1 is an oblique view of a second-level framework of acute-angularly connected toroidal elements as shown in FIG. 20 with most of the first-level toroidal frameworks, as shown in FIGS. 2 and 3, being schematically represented as toroids, and with one side of a yoke-connector inserted and engaged with first-level component frameworks.
Figure 2:
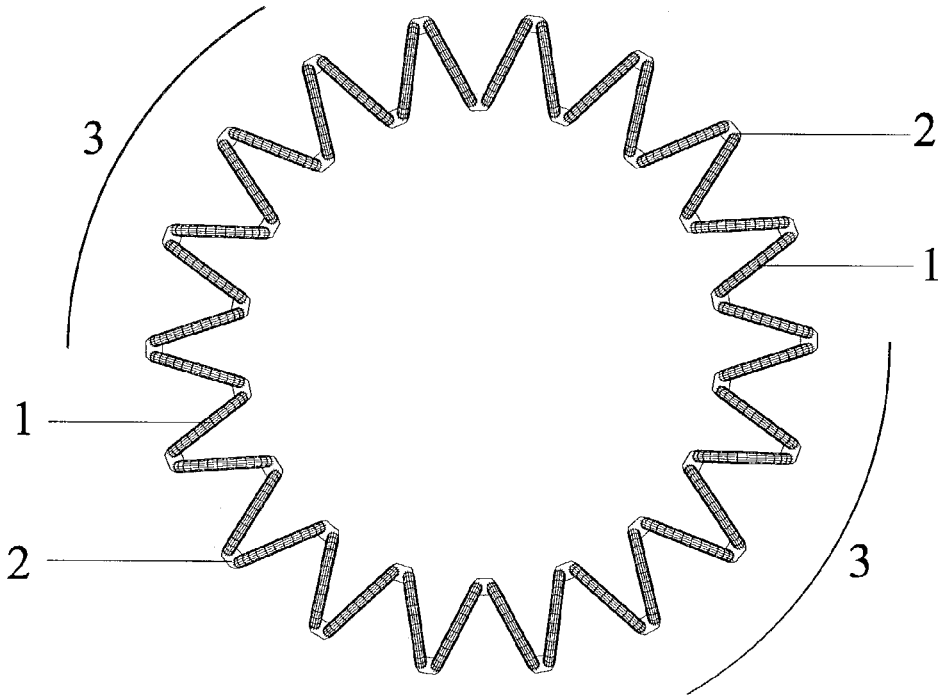
FIG. 2 is a plan view of a first-level framework of fundamental toroidal elements acute-angularly connected by couplings.
Figure 3:
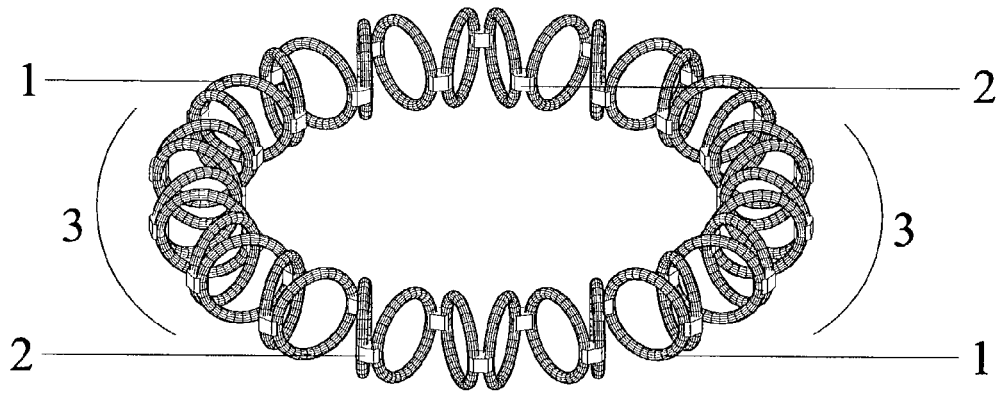
FIG. 3 is an oblique view of the framework of acute-anglarly connected fundamental toroidal elements shown in FIG. 2.
Figure 4:
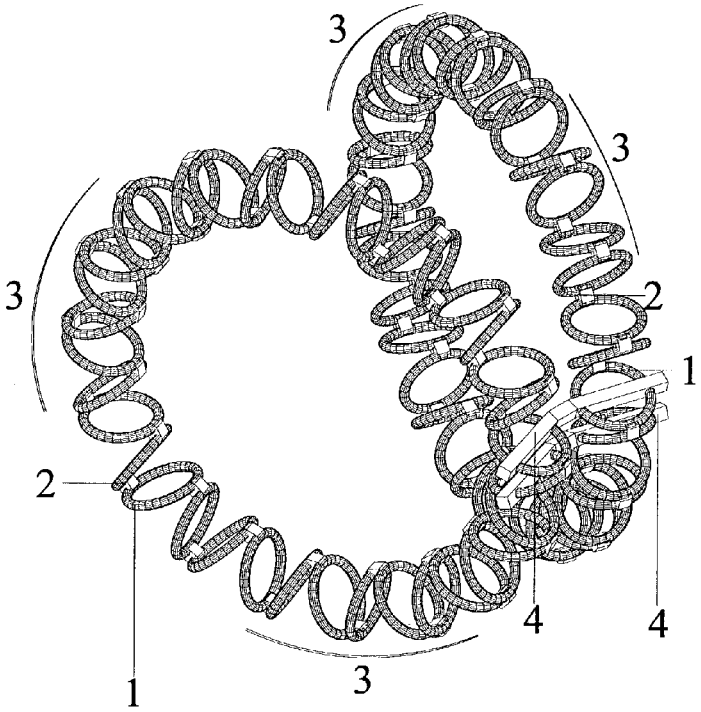
FIG. 4 is an oblique view of two first-level frameworks of acute-angularly connected fundamental toroidal elements as shown in FIGS. 2 and 3 acute-angularly connected with yoke-connectors.

A toroidally shaped framework may be constructed of other toroidal elements as shown in FIGS. 2 and 3: fundamental toroidal elements 1 acute-angularly connected with couplings 2 to form a toroidal framework 3. As shown in FIGS. 2 and 3 the acute-angular connection of the toroidal elements refers to the angle between the radius of each toroidal element (and not the radius of the cross-sectioton the tube of the toroidal element) extended to its vertex at the connection. A toroidally shaped framework may also be constructed with other toroidal frameworks as shown in FIG. 1, where the toroidally shaped frameworks of fundamental toroidal elements 3 (also represented schematically as toroids 5) are acute-angularly connected to form the toroidal framework 11.

A lug engages a toroidal element by direct contact between the lug surface and the toroidal element, and transmits force to a toroidal element in at least four modes: (1) by friction between the lug surface and the toroidal element; (2) by the lug surface pressing against a part of the toroidal element; (3) by surface locking; or (4) by jamming within a fundamental toroidal element (where the attempt to rotate the base forces the lug surfaces to engage the toroidal element in a space smaller than the spacing of the lug surfaces). Surface locking is a form of frictional engagement, where some feature of the lug surface locks with a feature of the surface of the fundamental toroidal element, such as edge and groove, or mutual knurling. An example of mode (2) of force transmission described above is shown in FIG. 1, where the lugs 8 have a flat surface proximate to and that directly contact the toroidal elements 3 of the toroidal framework. An example of modes (1) and (4) is shown in FIGS. 11–19 where the lugs 17, 19, 21, and 23 are in frictional contact with the interior of a fundamental toroidal element, and the lug surfaces jam in a chordal space within the toroidal element.

The arms may be fabricated using a common beam, as shown in FIGS. 4–8, or be fabricated separately from the other arms, as in FIG. 1, which shows one arm of a connector fabricated from two beams 6 and 7, and two lugs 8, with the addition of two reinforcing blocks 10 and 38, and an end-retainer 9. The function of the reinforcing blocks 10 and 38 are to maintain stiffness of the arms. The reinforcing blocks 10 and 38 shown in FIG. 1 are solid and completely fill the space between the beams 6 and 7. However, the reinforcing blocks are merely an example of reinforcement of the stiffness of the arms: such reinforcement may have any structural form that contributes to the stiffness of the arms, and reinforcing blocks 10 and 38 as such are not necessary to the invention. The function of the end-retainer 9 is to restrict movement of the toroidal elements 3 and 5 of the toroidal framework 11 to the proximity of the lugs 8, so that force is transmitted in mode (2), i.e. by the lug surface pressing against a part of the toroidal element. As in the case of the reinforcing blocks 10 and 38, end-retainers 9 are merely an example of structures for maintaining the toroidal elements 3 and 5 in the proximity of the lugs 8, and are not necessary to the invention as such. The manner in which the connector arm is inserted in the toroidal framework 11, and the materials of which the lugs 8 and toroidal elements 3 and 5 are composed, are likely to be sufficent to maintain such proximity. However, the maintenance of such proximity may be augmented by any structure that contributes to the restriction of the movement of the toroidal elements 3 and 5 to the proximity of the lugs 8, such as a reinforcing block 10 or a projection (not shown in the drawings) from the lugs 8 into the central hole of the toroidal elements 3 and 5.

The joining between the arms may be as a result of the fabrication from a common beam shown in FIGS. 4–8, or may be by any standard method of attachment or connection, and may include other components for bracing the joint created. The beams of which each arm is constructed may be straight, or have a bend or angulation. Where the yoke-connector arms are constructed as separate assemblies, the connector arms are joined to form a complete yoke-connector in the joint region. The joint may be adjustable so that the angle between the arms can be changed and locked so as to change the angle between the frameworks connected.

As shown in FIGS. 1, 4–8, and 11–19 the base and lug assembly for each arm of the connector forms a yoke about the toroidal element 11: thus the connector disclosed herein, shall hereinafter be referred to as a "yoke-connector". The term yoke-connector shall also be used to mean a connector with one or more arms that functions as a yoke-connector, and the region of space that includes an arm of a yoke-connector and the toroidal framework to which the yoke-connector is fitted shall be referred to as "region of the yoke-connection".

A force on a yoke-connector arm is transmitted to a toroidal element in the region of the yoke connection and creates a moment of torque about the axis of the toroidal element. Thus, the connection of toroidal frameworks to one another is such that a torque on one of the toroidal frameworks in the region of the yoke-connection will result in a torque on another toroidal framework in the region of the yoke-connection. As shown in FIG. 1 a force 60 on and in a direction perpendicular to the arm 6, 7, and 8 of the yoke-connector results in a contact between the lugs 8 and toroidal elements 3 of the toroidal framework 11, which creates a torque 61 about the axis 62 of the toroidal framework 11. To connect two or more toroidal frameworks each arm of a yoke-connector forms a yoke about at least one toroidal element of each of the toroidal frameworks. The type of lugs 8 shown in FIG. 1 shall also be referred to as "press-blocks". The term "press-block" shall mean a lug (such as 8) of such shape and size as to make contact with a sufficient extent of a toroidal element (such as 3) so as to be able to be able to exert a torque T, 61 force on the toroidal element (such as 11) in the general direction along the axis 62 of the toroidal element when an external force F, 60 is applied to the lug (such as 8) through the beams (such as 6 and 7).

In the case of toroidal torsion frameworks described in U.S. Pat. 6,334,284, a toroidal torsion element of a first one of the frameworks may be connected to a toroidal torsion element of a second one of the frameworks, so that a torque on one of the toroidal torsion elements in the first framework's region of yoke-connection will result in a torque on a toroidal torsion element of the second framework in that second framework's region of yoke-connection. In this way the yoke-connection between toroidal torsion elements of such frameworks can transmit torsional stress between such frameworks about the axis of the tubes of the frameworks in the region of yoke-connection, and thus to the entirety of each of the toroidal frameworks connected.

FIGS. 2 and 3 have previously been referred to as showing a toroidally shaped framework of fundamental toroidal elements 1 acute-angularly connected with couplings 2. Such a toroidal framework, being constructed of fundamental toroidal elements, shall hereinafter be referred to as a first-level toroidal framework (or, simply, first-level framework). The toroidally shaped framework shown in FIG. 1, being a framework of toroidal elements which are first-level frameworks, shall be referred to as a second-level toroidal framework (or, simply, second-level framework). Similarly, a toroidally shaped framework of elements which are second-level toroidal frameworks shall be referred to as a third-level framework; a toroidally shaped framework having third-level frameworks as elements, a fourth-level framework; a toroidally shaped framework having fourth-level frameworks as elements, a fifth-level toroidally shaped framework; and so on. Thus, the use of the invention is contemplated for the construction of higher-level toroidally shaped frameworks than are shown in the drawings.

The objects of the present invention are:

1. To provide a device for connecting toroidally shaped frameworks of toroidal elements;
2. To provide a device for connecting toroidally shaped frameworks of toroidal elements which is compatible with the use of such frameworks in low mass structures of large size;
3. To provide a process for the construction of multi-level toroidally shaped frameworks of toroidal elements using the yoke-connector disclosed herein; and
4. To provide a system for connection of toroidally shaped torsion frameworks that allows for the uniform distribution of torsional stress to the smallest of the toroidal torsion elements in the framework.

Figure 5:
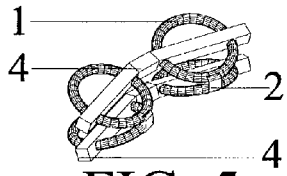
FIG. 5 is an oblique view of the four acute-angularly connected fundamental toroidal elements of the first-level frameworks shown in FIG. 4 which are engaged by the yoke-connectors as shown in FIG.4.
Figure 6:
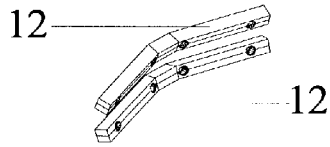
FIG. 6 is a pair of yoke-connectors as shown in FIG. 5, each of which are split along their length for engagement with toroidal elements by laterally enclosing the toroidal elements as shown in FIG. 5.
Figure 7:
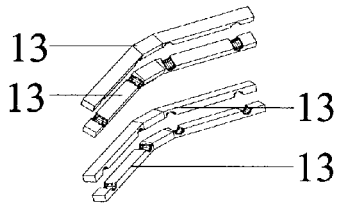
FIG. 7 is an exploded oblique view of the yoke-connectors shown in FIG. 6.
Figure 8:
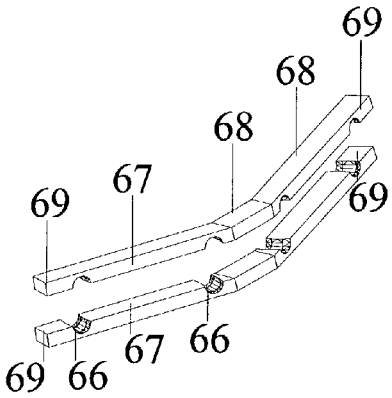
FIG. 8 is an exploded oblique view of one of the yoke-connectors shown in FIG. 7 from a direction opposite to that of the view shown in FIG. 7.
Figure 9:
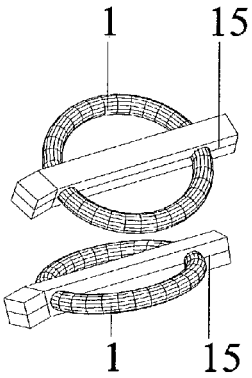
FIG. 9 is an oblique view of one arm of each of the pair of yoke-connectors shown in FIG. 6, each arm engaging a fundamental toroidal element.
Figure 10:
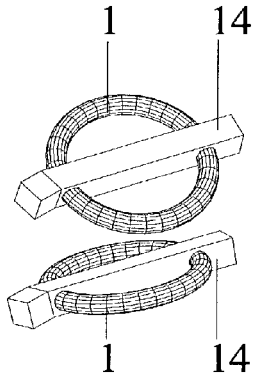
FIG. 10 is an oblique view of one arm of each of the pair of yoke-connectors shown in FIG. 5, each molded with a fundamental toroidal element.

Having introduced the basic features of the present invention with FIGS. 1–3, this disclosure shall now be directed to other features and the embodiments that are possible therewith. Beginning with FIGS. 4–8 showing the connectors 4 for first-level toroidal frameworks 3, previously alluded to with respect to arms fabricated with a common beam, the two lug surfaces 66 that are in contact with and transmit force to the fundamental toroidal element 1 are formed to the shape of the fundamental toroidal element 1, and are integrated with the formation of the beam 68, as are the lugs 67. These two lug surfaces 66 may function frictionally, or may be fixed to the fundamental toroidal element 1 at the locations shown in FIGS. 4 and 5, and in FIG. 10 where an arm 14 of the connector 4 is molded with the fundamental toroidal element 1. As can be seen from FIGS. 6–8 the common beams 12 may be fabricated with the arms split along their length 12 and 13 for frictional engagement with fundamental toroidal elements by laterally enclosing the toroidal elements 1 as shown in FIG. 5. The splitting of the arms with integrated beam and lug construction 15 is also shown in FIG. 9.

Figure 11:
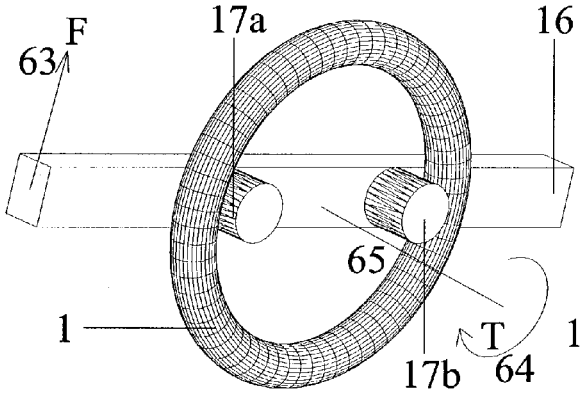
FIG. 11 is an oblique view of one arm of a yoke-connector with a single beam and two cylindrical lugs engaging a fundamental toroidal element.
Figure 12:
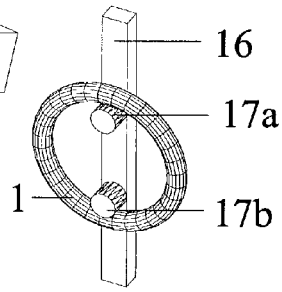
FIG. 12 is another oblique view of the yoke-connector shown in FIG. 11.
Figure 13:
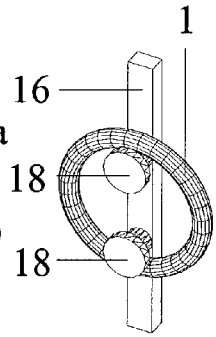
FIG. 13 is an oblique view of the yoke-connector shown in FIG. 12 with disk side-retainers attached to the lugs.
Figure 14:
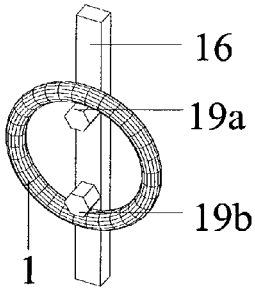
FIG. 14 is an oblique view of one arm of a yoke-connector with a single beam and two hexagonal prismatic lugs engaging a fundamental toroidal element.
Figure 16:
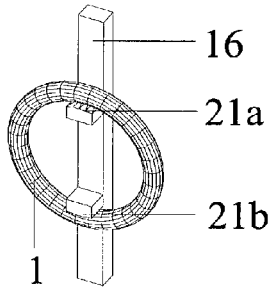
FIG. 16 is an oblique view of one arm of a yoke-connector with a single beam and two lugs, each lug wit a surface matching the interior curvature of a fundamental toroidal element, and engaged with the fundamental toroidal element.
Figure 18:
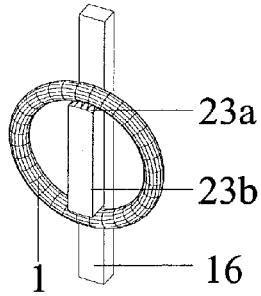
FIG. 18 is an oblique view of one arm of a yoke-connector with a single beam and a single lug with two surfaces, the surfaces matching the interior curvature of a fUndamental toroidal clement, and engaged with the fundamental toroidal element.

The engagement of the cylindrical lug 17*b* surfaces 17*a* in direct contact with a fundamental toroidal element 1 is shown in FIGS. 11 and 12, in which a force on a yoke-connector beam 16 may be transmitted to a fundamental toroidal element 1 by modes (1), (3), or (4). Other examples of transmission of force on a yoke-connector beam 16 to a fundamental toroidal element 1 by modes (1), (3) and (4) are shown in FIGS. 16 (and 18), where the lug 21*b* (and 23*b*) surfaces 21*a* (and 23*a*) are formed to the inner surface of the fundamental toroidal element 1. Transmission of force on a yoke-connector beam 16 to a fundamental toroidal element 1 by surface locking is shown in FIG. 14 where the lug 19*a* surfaces 19*b* engage surface features of the inner surface of the fundamental toroidal element 1. Modes (1), (3) and (4) of engagement can also be augmented by maintaining alignment of the fundamental toroidal element with the lugs 17*a*, 19*a*, 21*a*, and 23*a* by the use of side-retainers 18 (disk), 20 (disk), 22 (plate), and 24 (second beam) shown respectively in FIGS. 13, 15, 17, and 19.

The connector arms shown in FIGS. 11–19 function in the same way as previously discussed for FIG. 1 with respect to transmission of a force F, 63 on a beam 16 of a yoke-connector to a toroidal element 1 in the region of the yoke connection, and thereby transmission of torsional stress between frameworks in a yoke connection: creation of a moment of torque T, 64 about the axis 65 of the fundamental toroidal element 1 in the first-level framework (shown in FIGS. 2 and 3). As shown by the example in FIG. 11, a force F, 63 on the arm and in a direction perpendicular to the arm 16 of the yoke-connector results in a mode (1), (3), or (4) engagement between the lug 17*b* surfaces 17*a* and the fundamental toroidal element 1, which creates a torque T, 64 about the axis 65 of the fundamental toroidal element 1.

Figure 15:
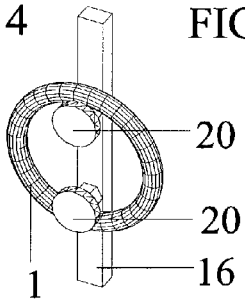
FIG. 15 is an oblique view of the yoke-connector shown in FIG. 14 with disk side-retainers attached to the lugs.
Figure 17:
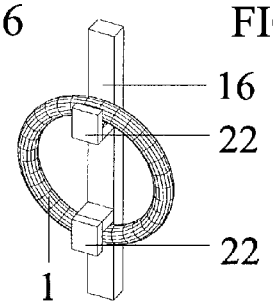
FIG. 17 is an oblique view of the yoke-connector shown in FIG. 16 with plate side-retainers attached to the lugs.
Figure 19:
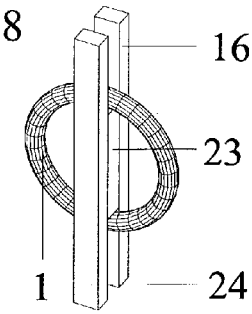
FIG. 19 is an oblique view of the yoke-connector shown in FIG. 18 with a second beam/side-retainer attached.
Figure 20:
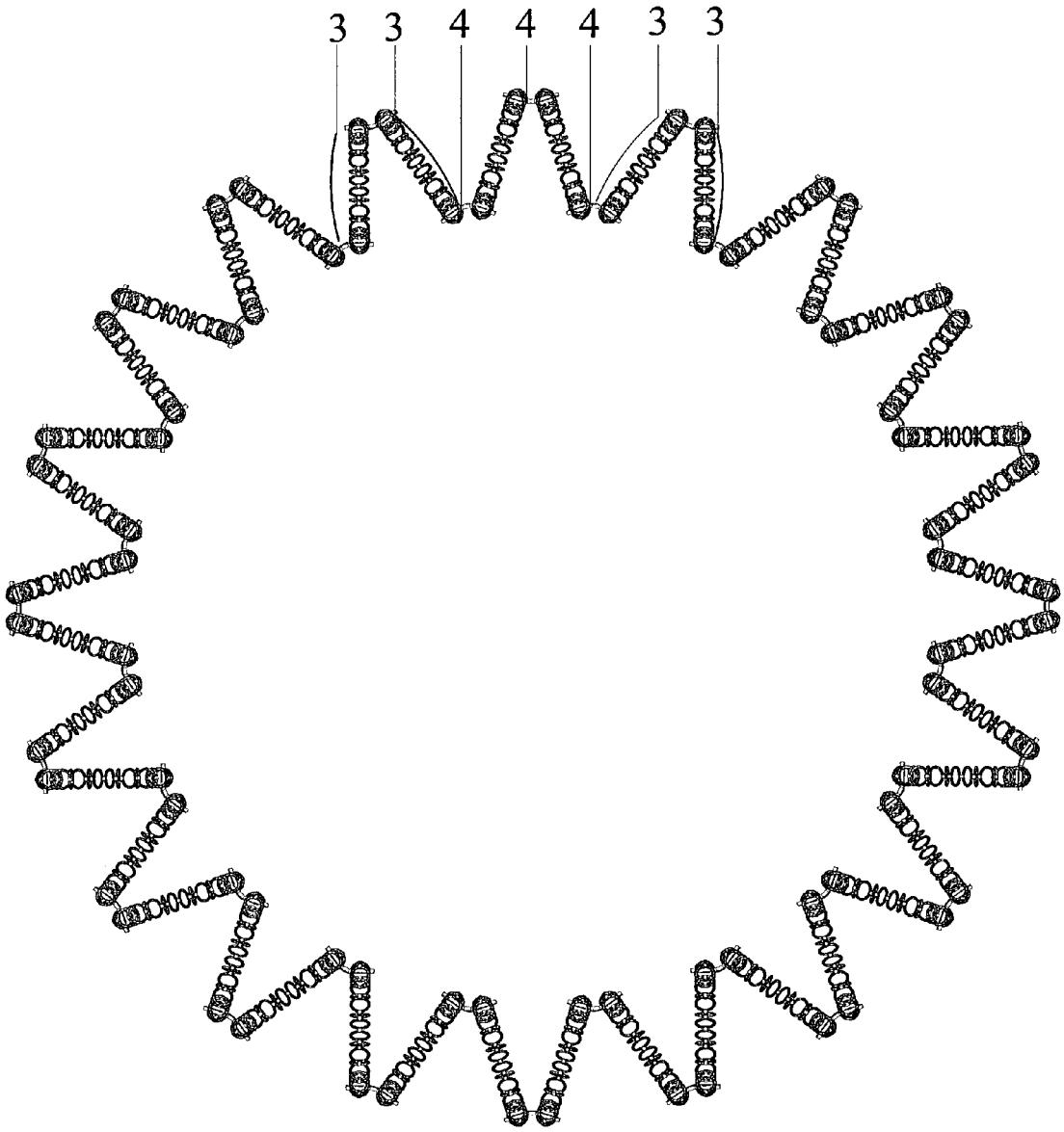
FIG. 20 is a plan view of a second-level toroidal framework formed by acute-angular connection of first-level toroidal frameworks (as shown in FIGS. 2 and 3) with yoke-connectors shown in FIGS. 4–8.
Figure 21:
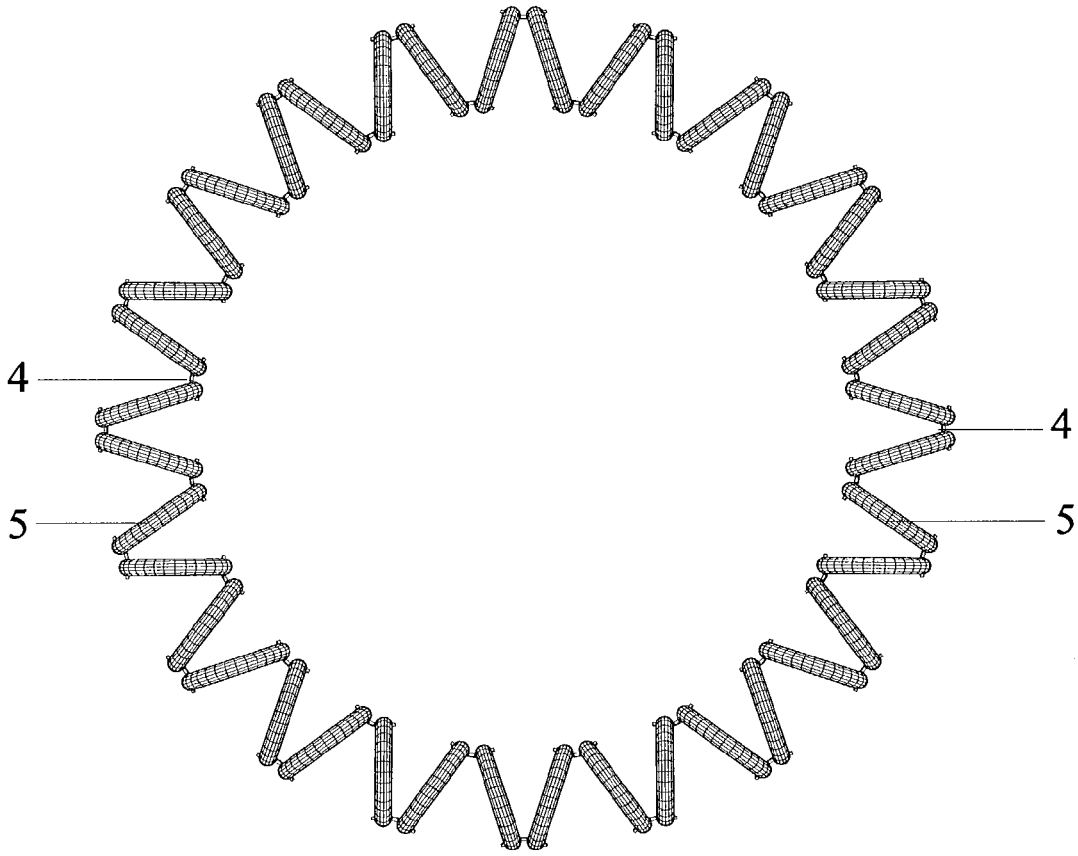
FIG. 21 is a plan view of the second-level toroidal framework shown in FIG. 20 with the acute-angularly connected first-level toroidal frameworks schematically represented as toroids as shown FIG. 1.
Figure 22:
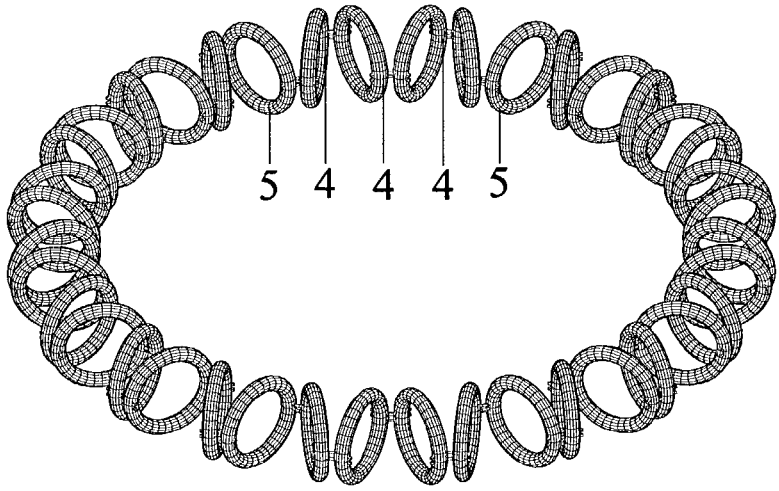
FIG. 22 is an oblique view of the second-level toroidal framework shown in FIG. 21.
Figure 23:
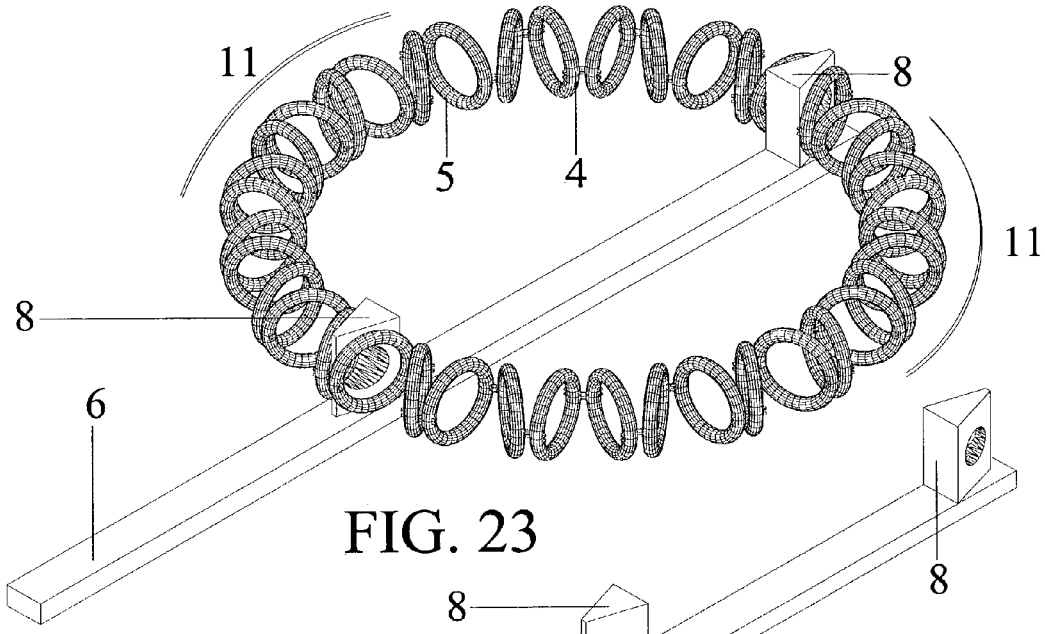
FIG. 23 is an oblique view of the second-level toroidal framework shown in FIGS. 1 and 20–22 with one arm of single-beam yoke-connector inserted and engaged with schematically represented first-level component frameworks.
Figure 24:
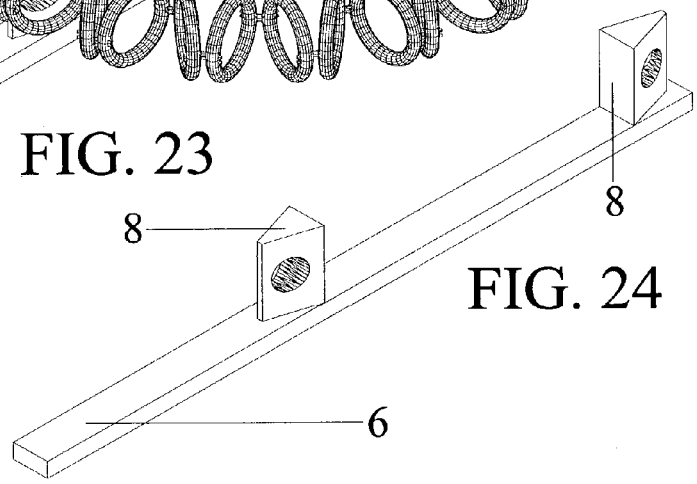
FIG. 24 is an oblique view of the single-beam yoke-connector shown in FIG. 23.
Figure 27:
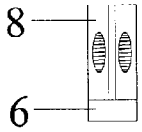
FIG. 27 is an end view of the single-beam yoke-connector shown in FIG. 24.
Figure 25:
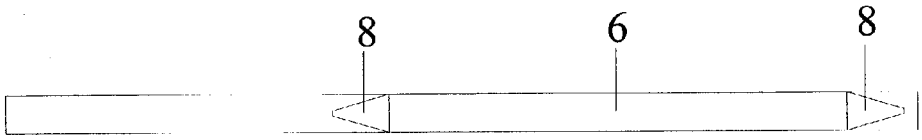
FIG. 25 is a plan view of the single-beam yoke-connector shown in FIG. 24.
Figure 26:
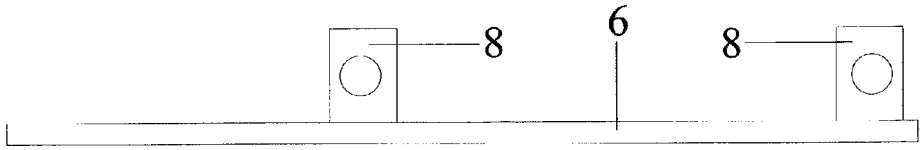
FIG. 26 is a side view of the single-beam yoke-connector shown in FIG. 24.
Figure 28:
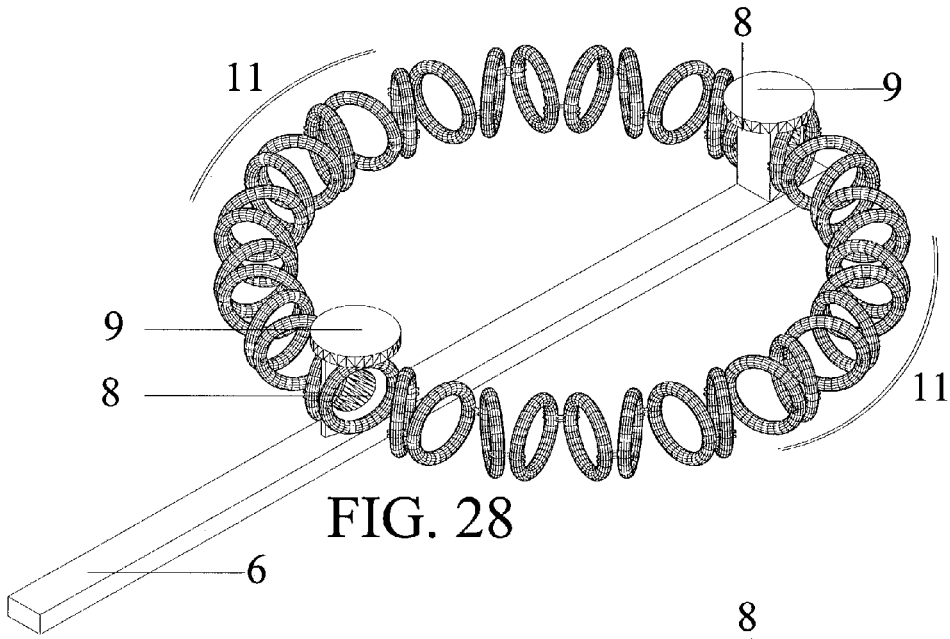
FIG. 28 is an oblique view of the toroidal framework and yoke-connector configuration shown in FIG. 23 with disk side-retainers.

FIGS. 20–22 are different representations of the same second-level toroidal framework with yoke-connectors 4 joining the first-level elements 3 as shown in FIGS. 4–8: FIG. 20 being a plan view showing the details of the first-level frameworks 3; FIG. 21 being a plan view showing the first-level frameworks 3 in schematic representation 5 with connectors; and FIG. 22 being an oblique view of the toroidal framework shown in FIG. 21. The representation of the second-level toroidal framework in FIG. 22 is used in FIGS. 23, 28, and 29 to demonstrate various embodiments of the yoke-connectors with lugs that are press-blocks, and which may hereinafter be referred to alternatively as press-blocks or "press-block lugs". One of such embodiments is shown in FIGS. 23–27 engaged with the second-level framework 11 shown in FIG. 22, one arm of a single beam 6 yoke-connector with two press-blocks 8. A second embodiment is shown in FIG. 28 which is identical to the yoke-connector shown in FIG. 23, but with the addition of disk side-retainers 9 as shown in FIGS. 13 and 15. As in the case of the yoke-connectors shown in FIGS. 13 and 15 a disk side-retainer 9 attached to a press-block lug 8 confines the toroidal framework 11 within the yoke-connector at that press-block 8 on the side of the toroidal framework opposite the beam 6. A third embodiment of a yoke-connector 26 is shown in FIG. 29, which is identical to the yoke-connector 6–8 and 10 shown in FIG. 1, but without the reinforcing block 10, utilizing the second beam 7 as a side-retainer for the purpose of confining the toroidal framework 11 engaged within the yoke of the yoke-connectors.

Figure 29:
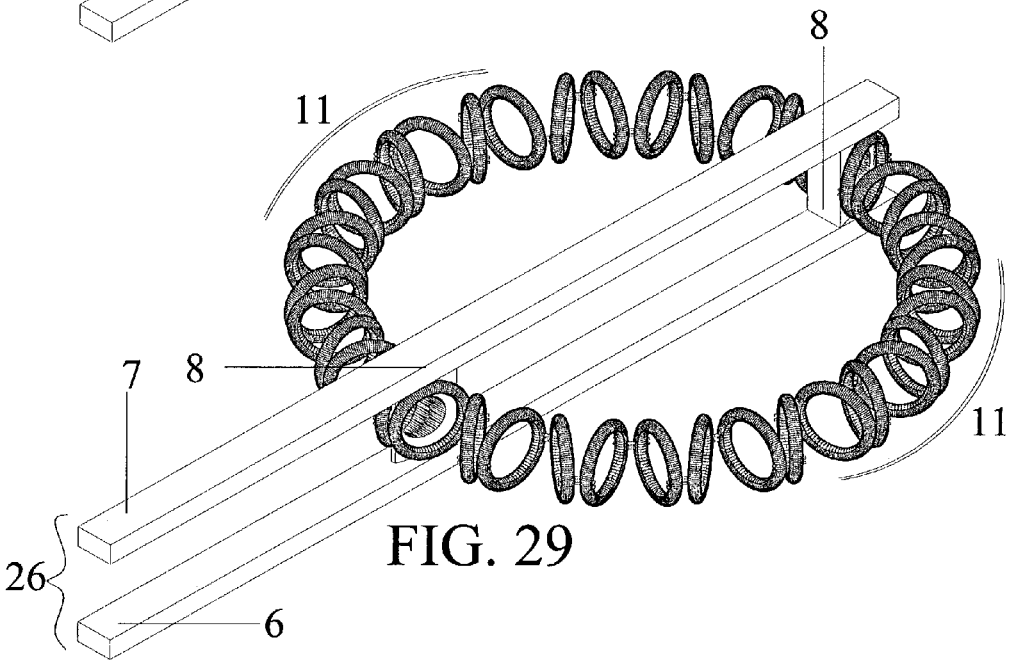
FIG. 29 is an oblique view of the toroidal framework and yoke-connector configuration shown in FIG. 23 with a second beam.
Figure 30:
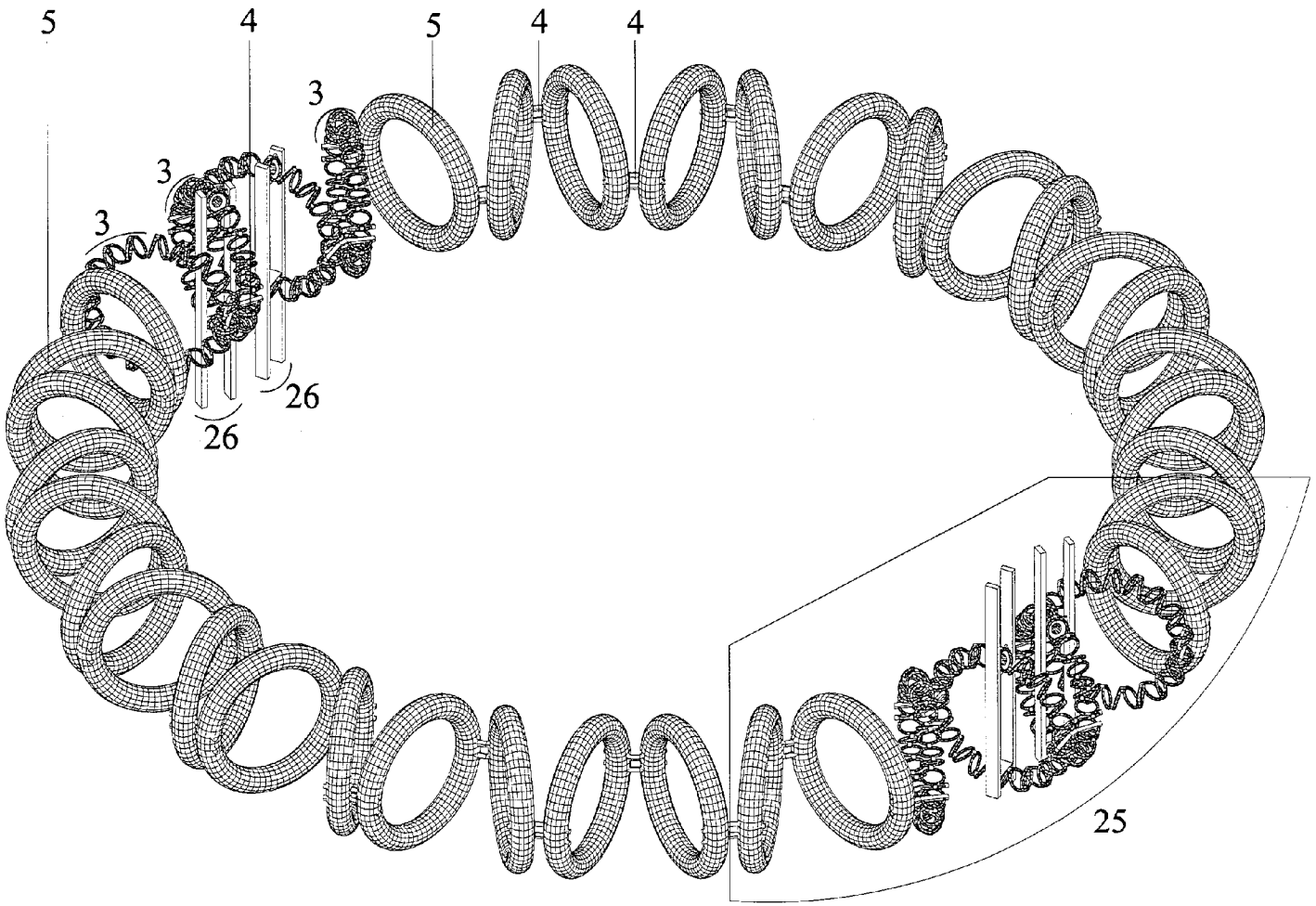
FIG. 30 is an oblique view of a second-level toroidal framework as shown in FIGS. 1, 20–22, 23, and 28–29 with the first-level toroidal frameworks engaged by the type of yoke-connector shown in FIG. 29.
Figure 32:
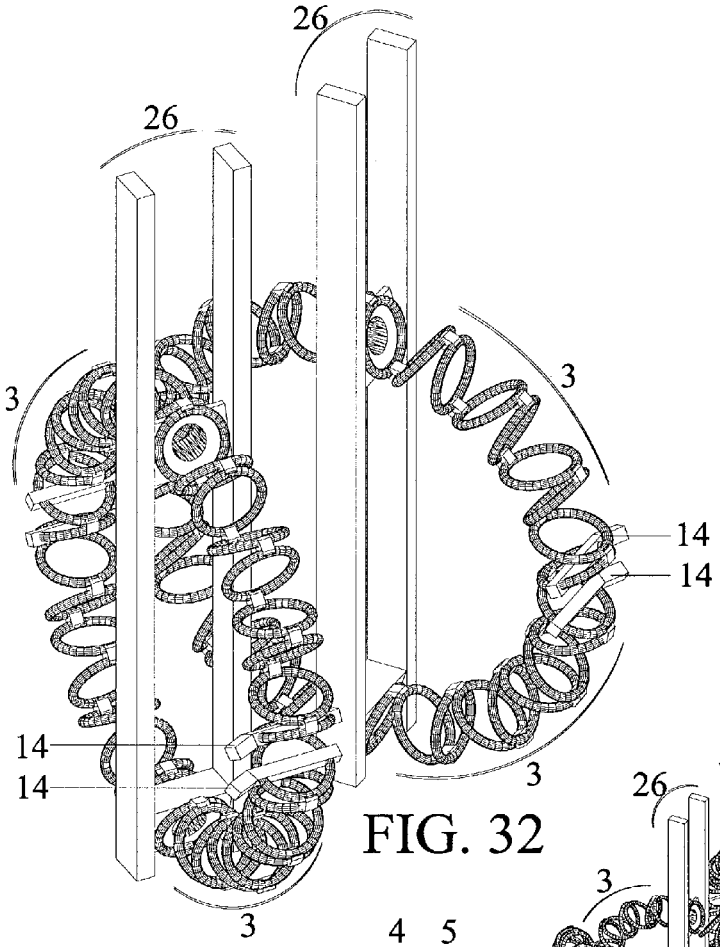
FIG. 32 is an enlarged view of the first-level toroidal frameworks with the inserted yoke-connectors inserted as shown in FIG. 31.
Figure 31:
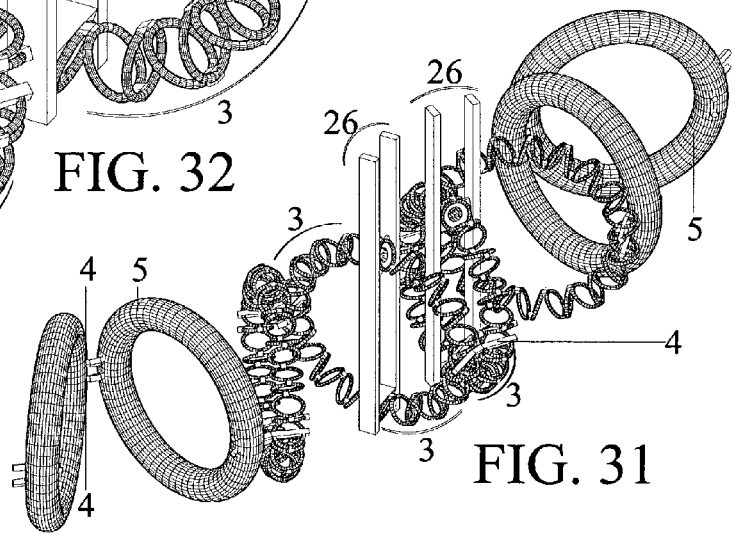
FIG. 31 is an enlarged view of the outlined region shown in FIG 30.
Figure 33:
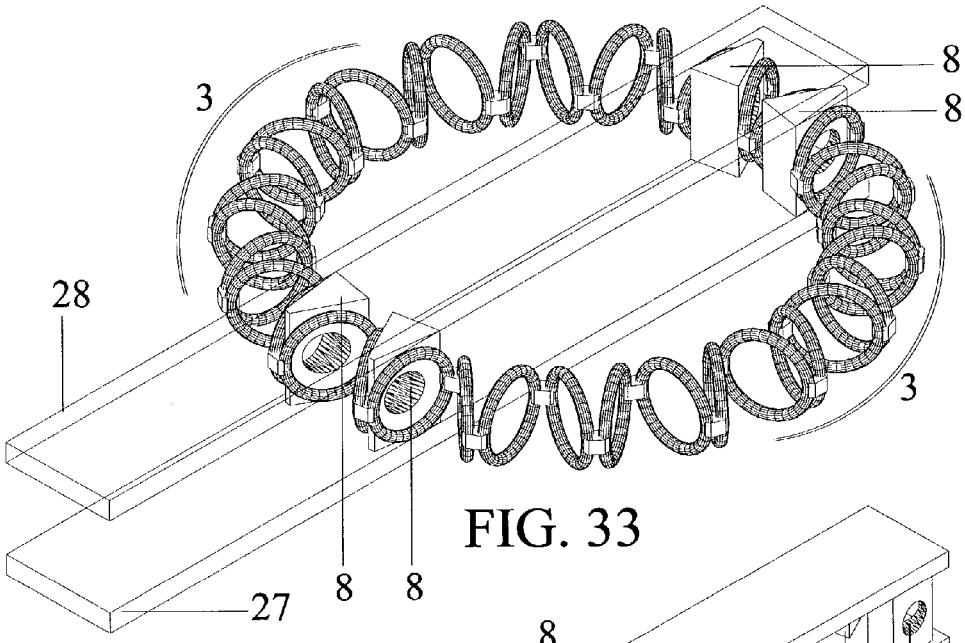
FIG. 33 is an oblique view of to first-level toroidal framework shown in FIGS. 2 and 3 with one arm of a double-beam yoke-connector with four lugs inserted and engaged with fundamental toroidal elements.
Figure 34:
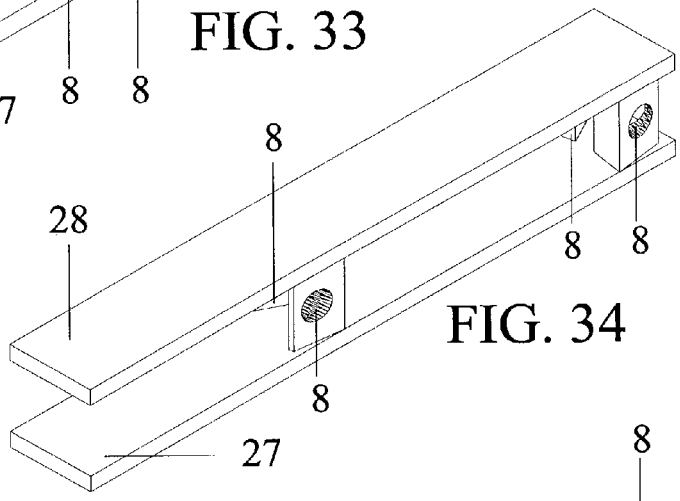
FIG. 34 is an oblique view of the double-beam yoke-connector shown in FIG. 33.
Figure 36:
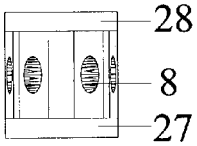
FIG. 36 is an end view of the single-beam yoke-connector shown in FIG. 34.
Figure 35:
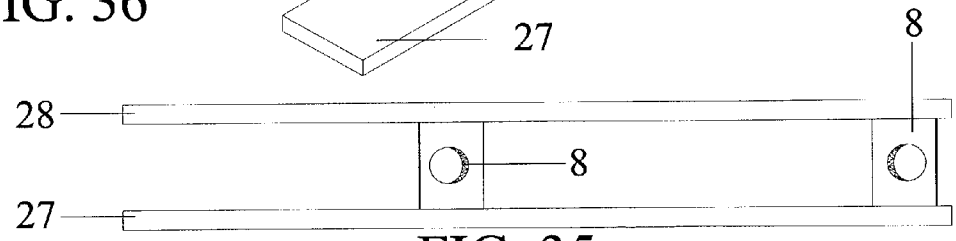
FIG. 35 is a side view of the single-beam yoke-connector shown in FIG. 34.

FIG. 30 is a second-level framework of first-level frameworks acute-angularly connected by connectors 4 as shown in FIGS. 20–22, with most of the first-level frameworks 3 schematically represented 5, but with yoke-connector arms 26 such as shown in FIG. 29 inserted and engaging four first-level frameworks 3. Such an application of the yoke-connectors 26 is for the purpose of acute-angularly connecting the second-level framework shown to other such frameworks to form a third-level toroidally shaped framework. A section 25 of that second-level framework is shown in FIG. 31 in an enlarged view so that the yoke-connectors 4 can be seen; and a smaller section of two first-level frameworks 3 further enlarged in FIG. 32 to show the individual arms 14 of the yoke-connectors 4 and a larger view of the yoke-connectors 26 engaging the first-level frameworks 3.

Figure 37:
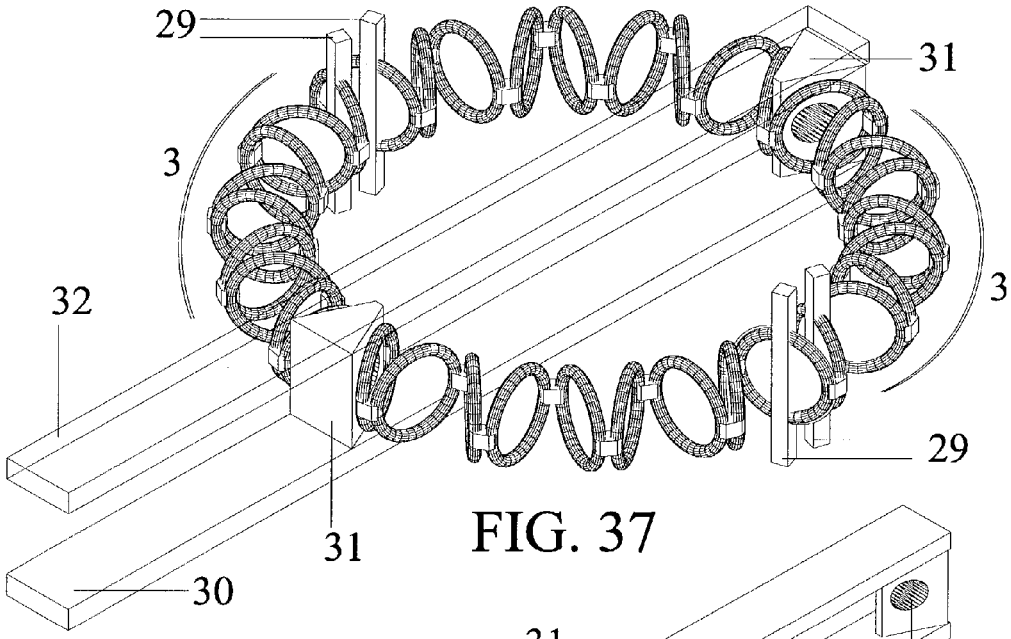
FIG. 37 is an oblique view of the first-level toroidal framework shown in FIGS. 2 and 3 with one arm of an alternate form of double-beam yoke-connector wit two lugs inserted and engaged, four of the fundamental toroidal elements of which are molded with arms of a yoke-connector as shown in FIG. 10.
Figure 38:
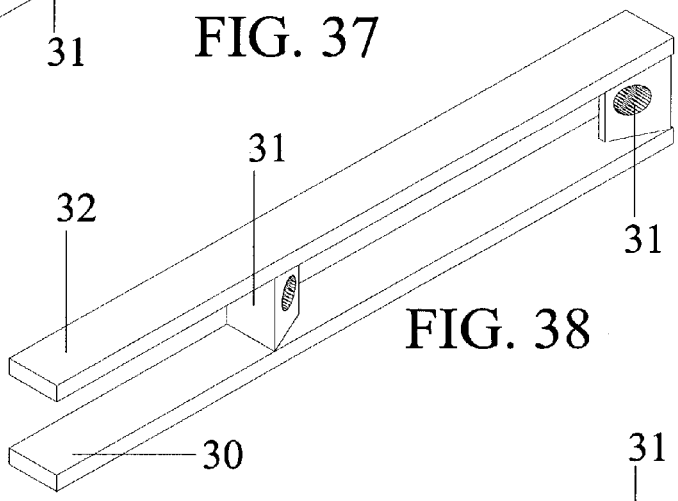
FIG. 38 is an oblique view of the double-beam yoke-connector shown in FIG. 37.
Figure 40:
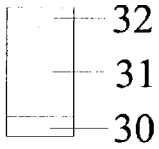
FIG. 40 is an end view of the double-beam yoke-connector shown in FIG. 38.
Figure 39:
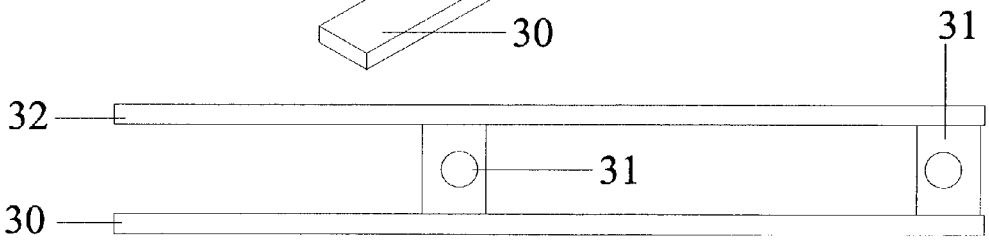
FIG. 39 is a side view of the double-beam yoke-connector shown in FIG. 38.

A fourth and fifth embodiment of yoke-connectors utilizing press-block lugs are shown in FIGS. 33–40, but inserted and engaging first-level frameworks 3 for a purpose similar to that shown in FIG. 29. Although shown as inserted into first-level frameworks, the use of such yoke-connectors is not so limited, and such yoke-connectors may be inserted into second-and-higher-level frameworks. In the fourth embodiment the yoke-connector shown inserted into a first-level framework in FIG. 33 has four press-block lugs 8 with two beams 27 and 28, the latter being represented as transparent, operates in the same manner as the yoke-connector shown in FIG. 1. Unlike the other embodiments of the yoke-connector, where the press-block lugs were inserted in the inner angulation of a toroidal framework, the fifth embodiment of the yoke-connector, shown in FIGS. 37–40 with two press-block lugs 31 and two beams 30 and 32, engages the toroidal elements of a toroidal framework by insertion in the outer angulation of the toroidal framework, as shown in FIG. 37. In the case of all of the embodiments of yoke-connectors with two beams and press-block lugs, the beams act to confine the toroidal element with the yoke of the yoke-connector.

Figure 41:
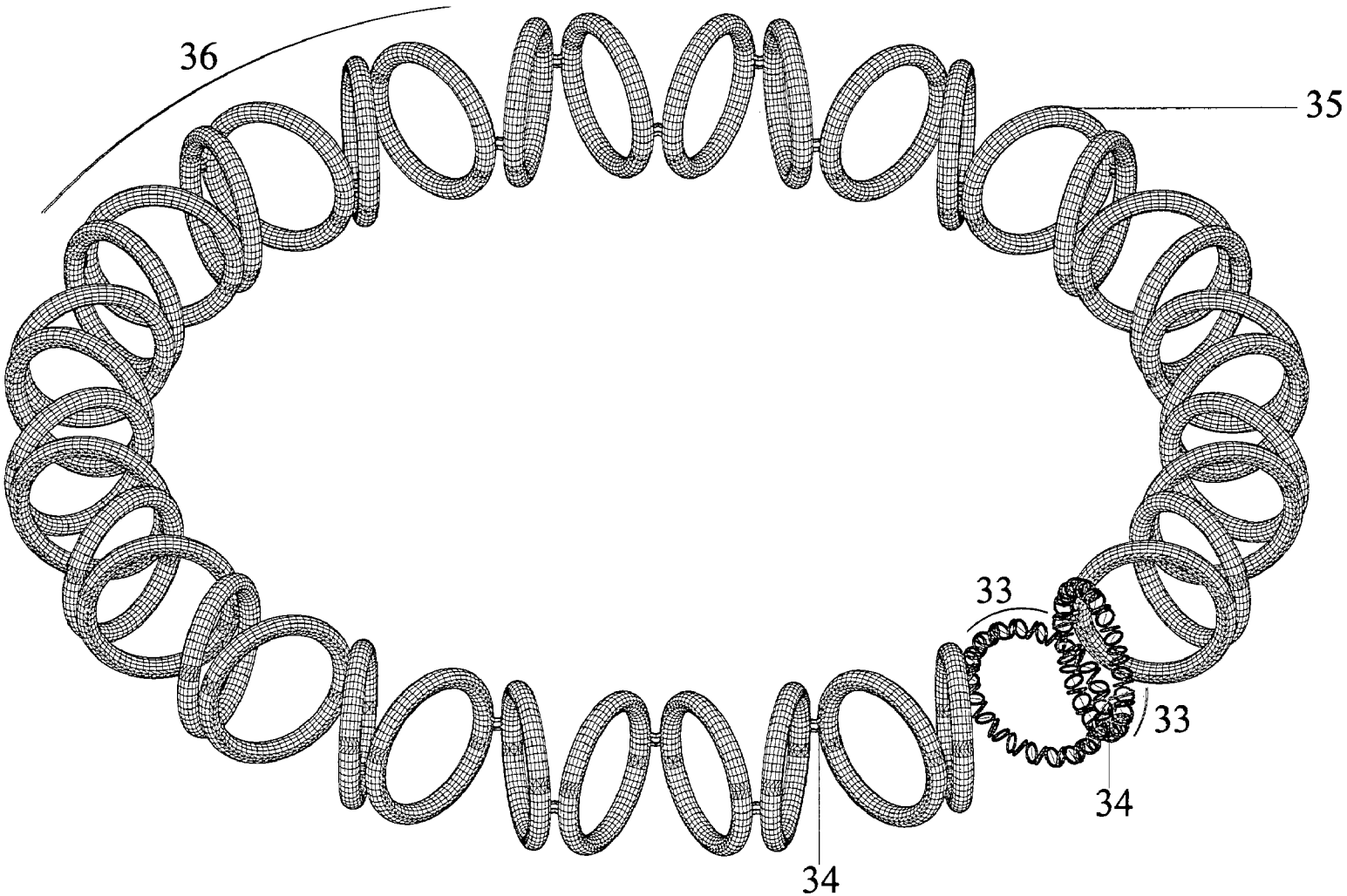
FIG. 41 is an oblique view of a fourth-level toroidal framework formed by acute-angular connection of third-level toroidal frameworks.
Figure 42:
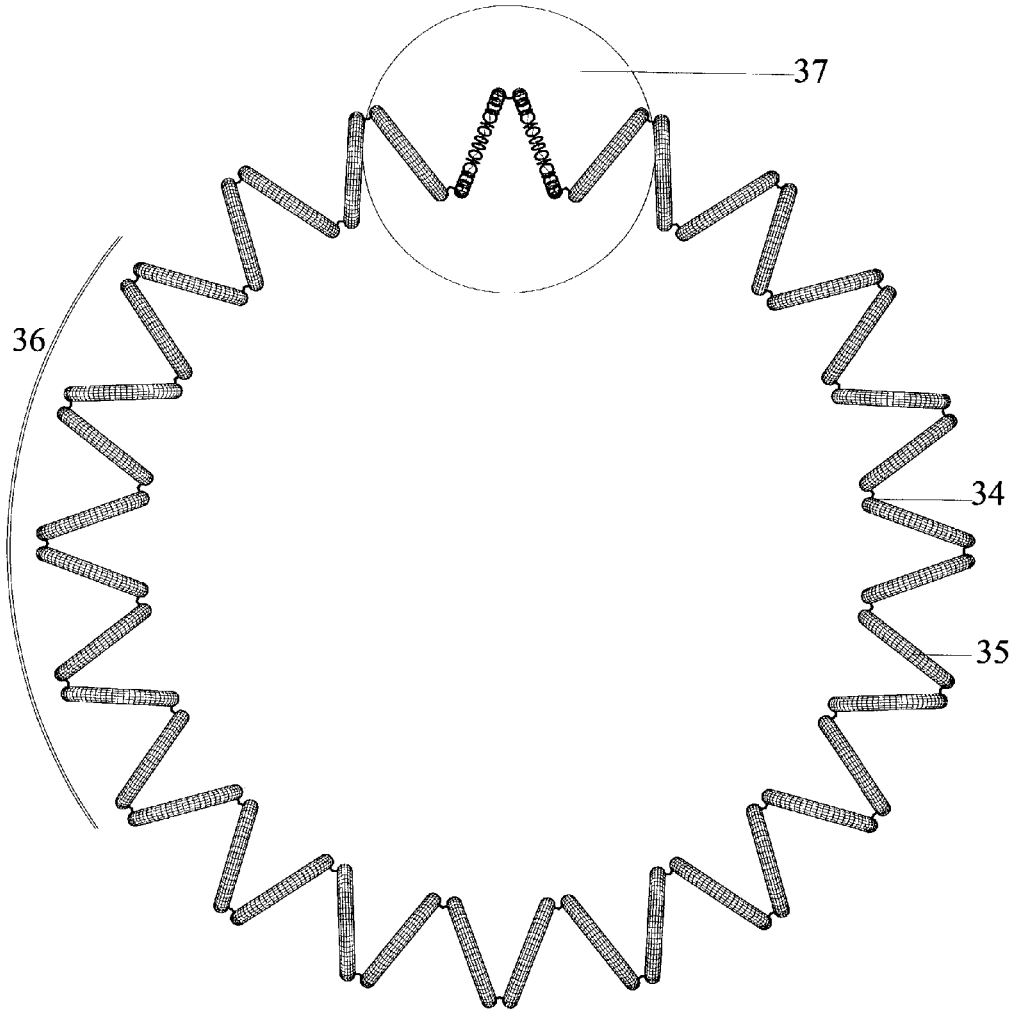
FIG. 42 is a plan view of the fourth-level toroidal framework shown in FIG. 41.
Figure 43:
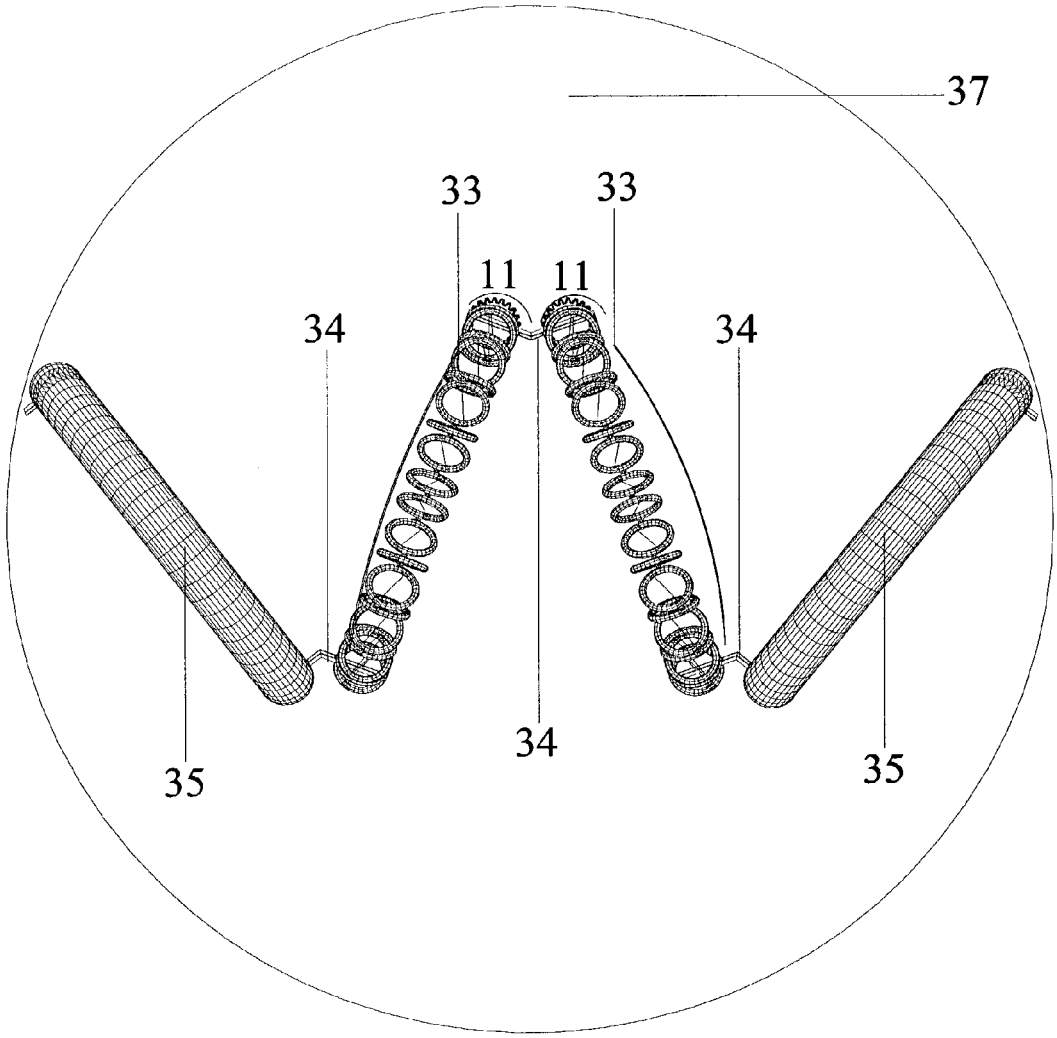
FIG. 43 is an enlarged plan view of the outlined region shown in FIG. 42.
Figure 44:
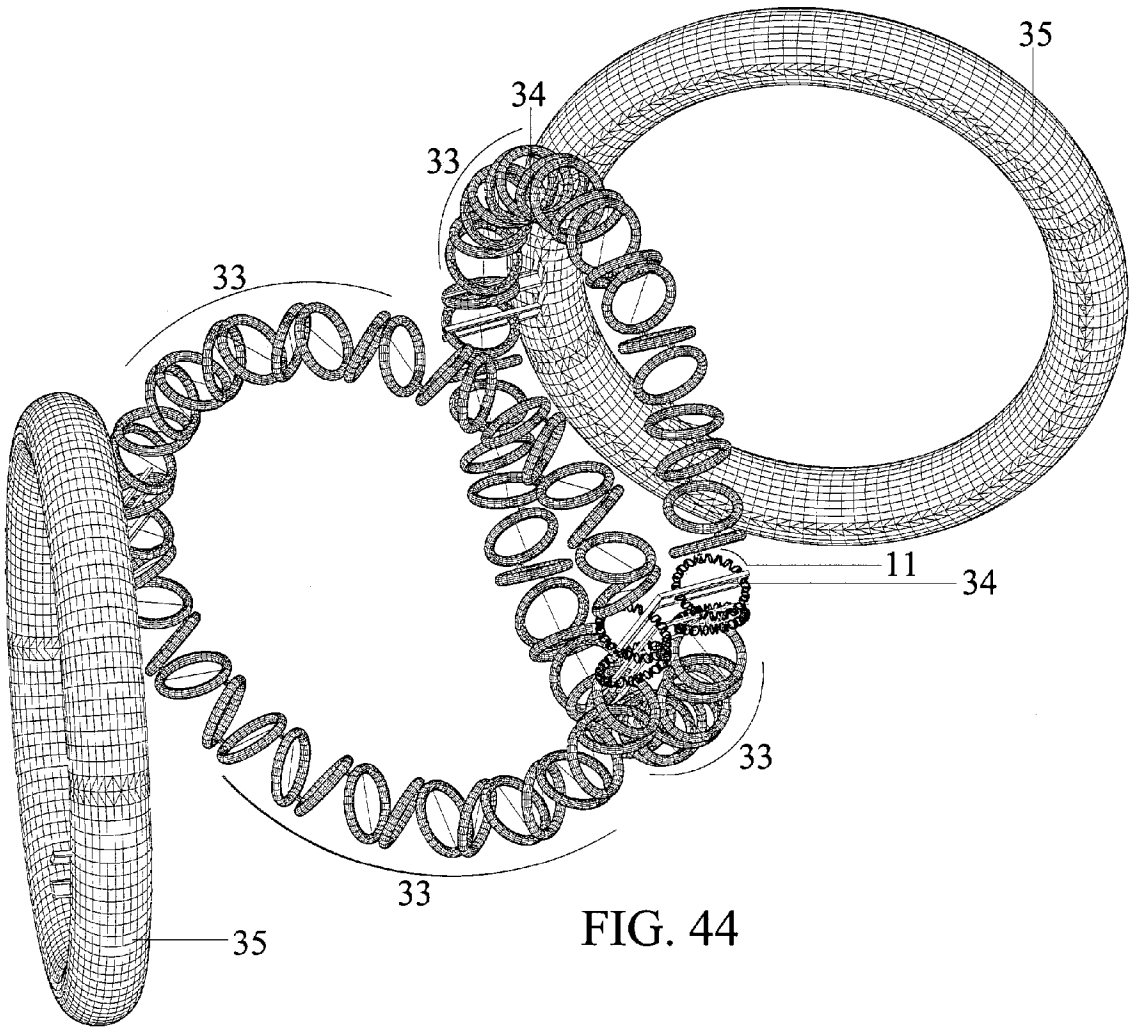
FIG. 44 is an enlarged oblique view of the outlined region shown in FIG. 43.
Figure 45:
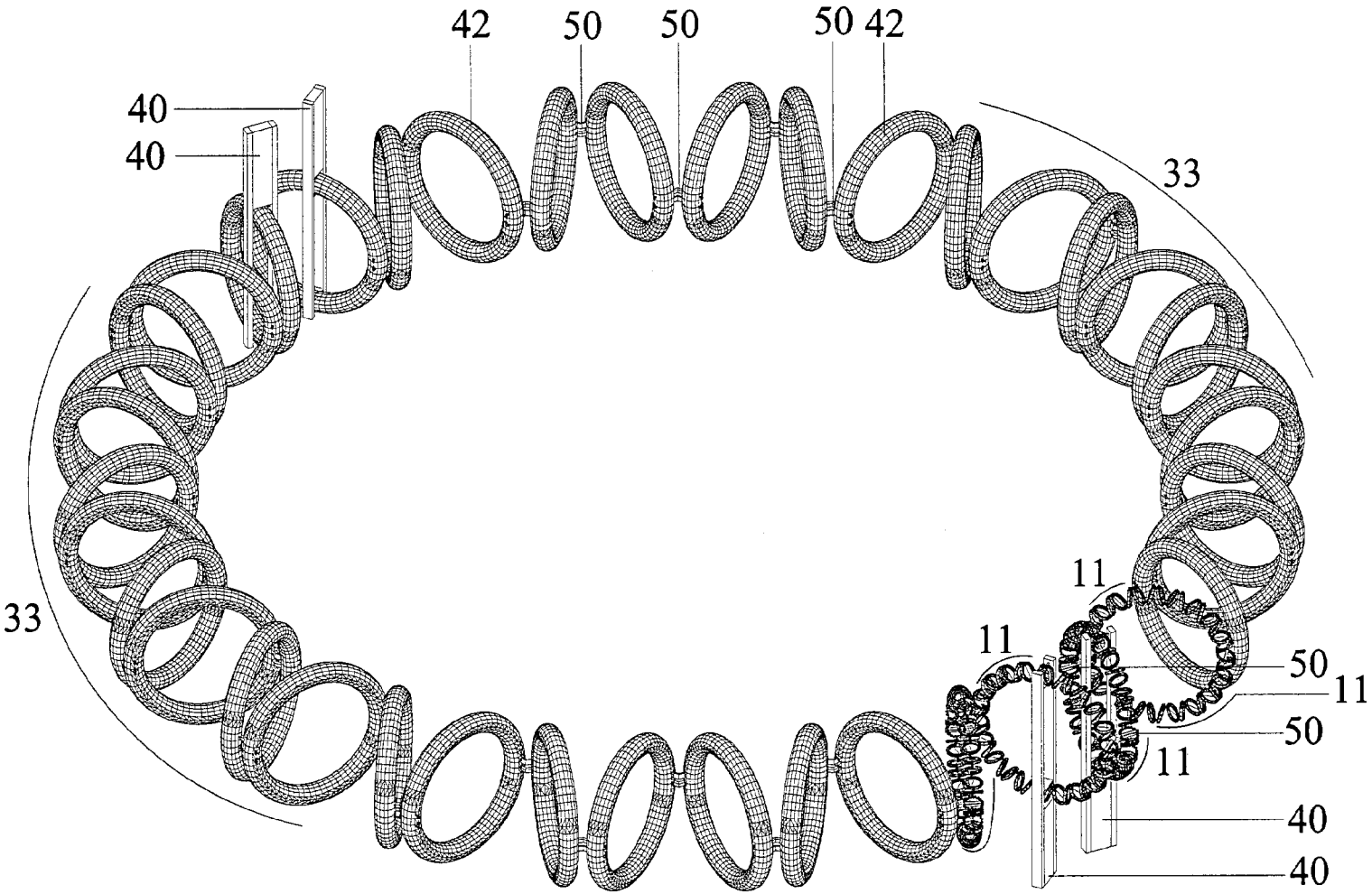
Figure 46:
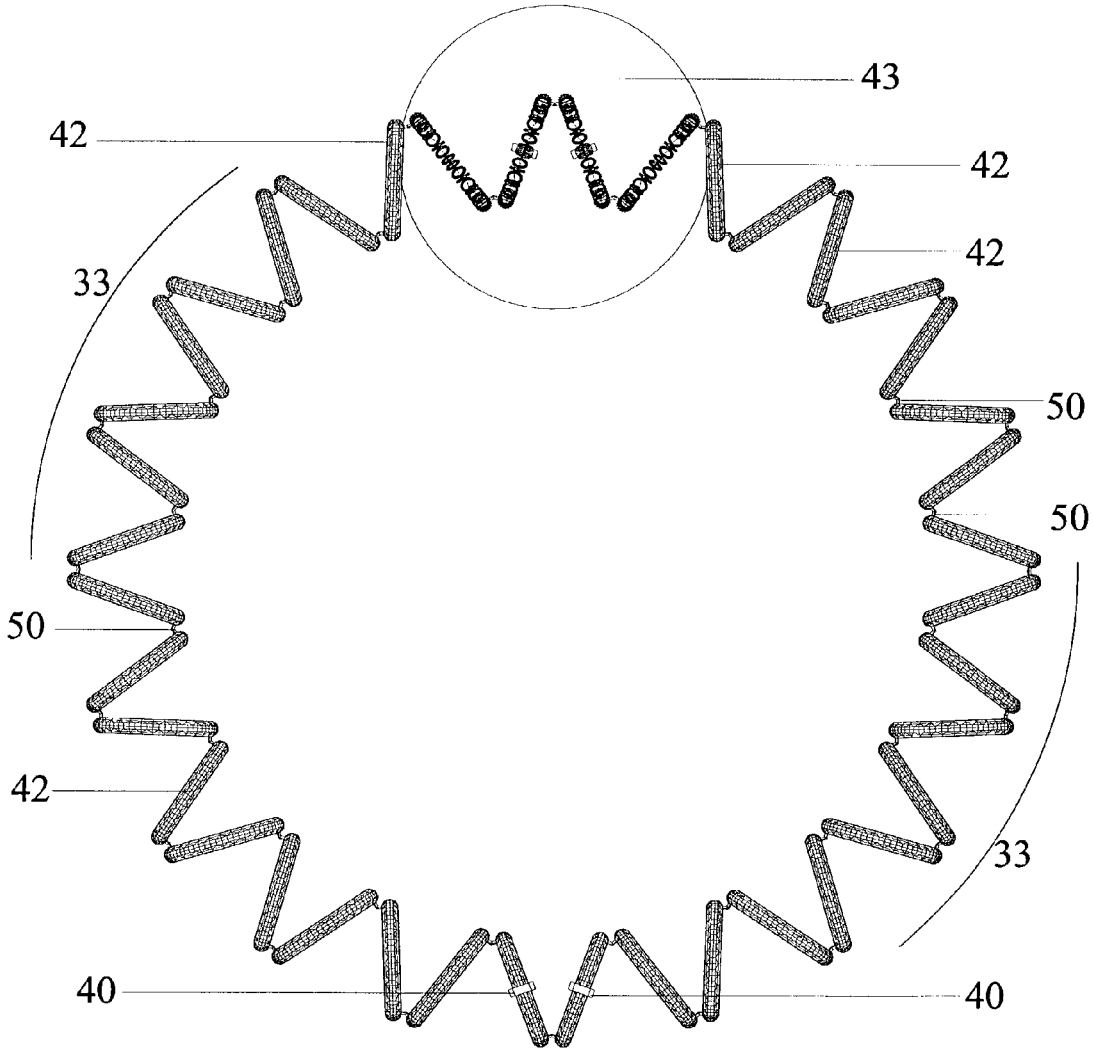
FIG. 46 is a plan view of the third-level toroidal framework shown in FIG. 45.
Figure 47:
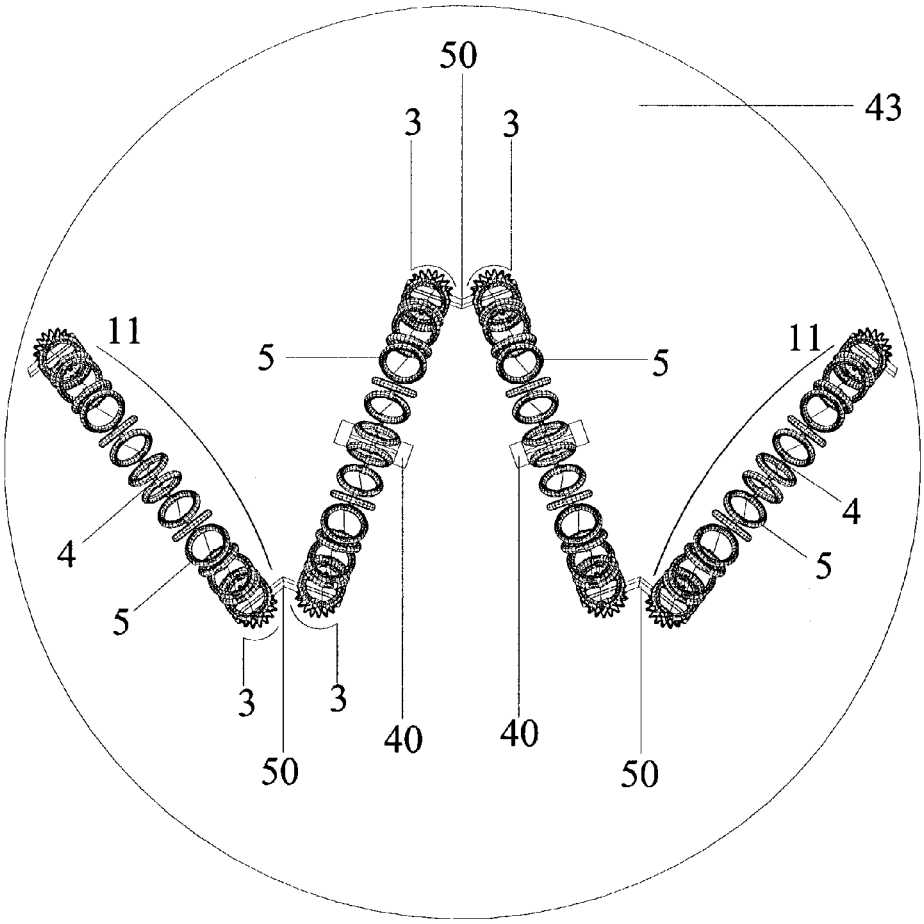
FIGS. 47 and 48.
Figure 48:
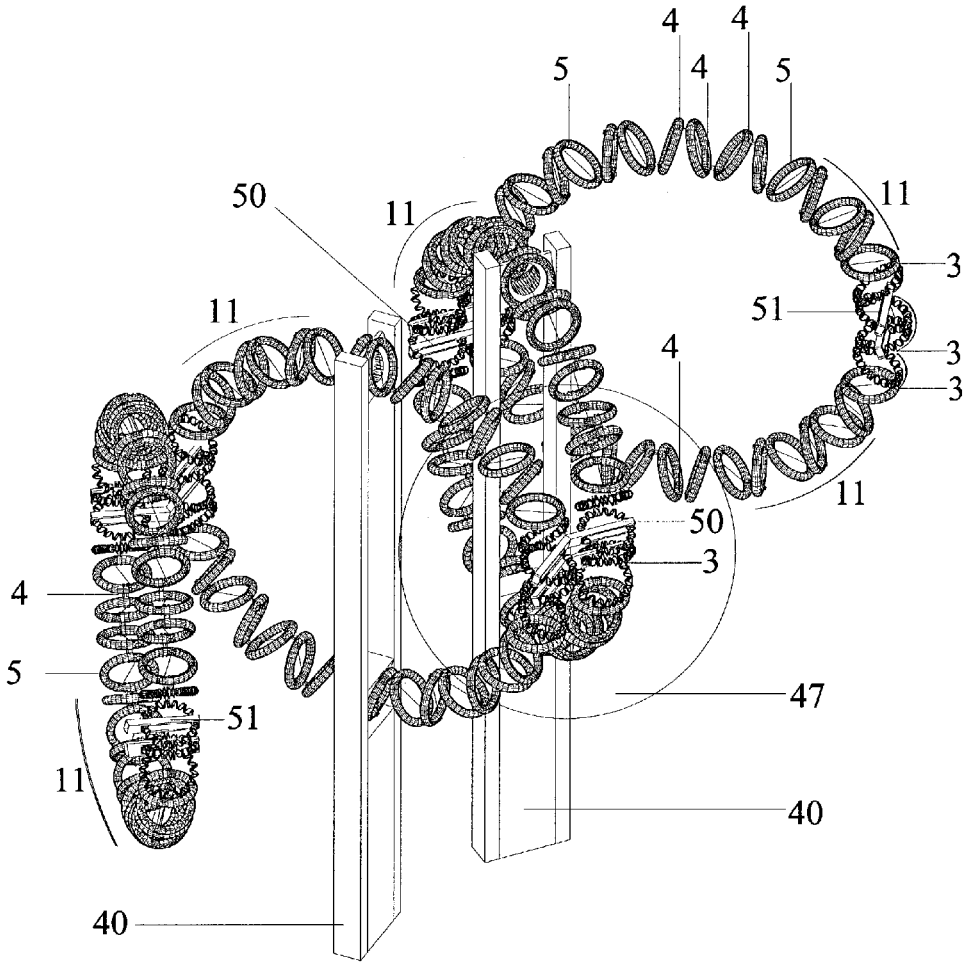
Figure 49:
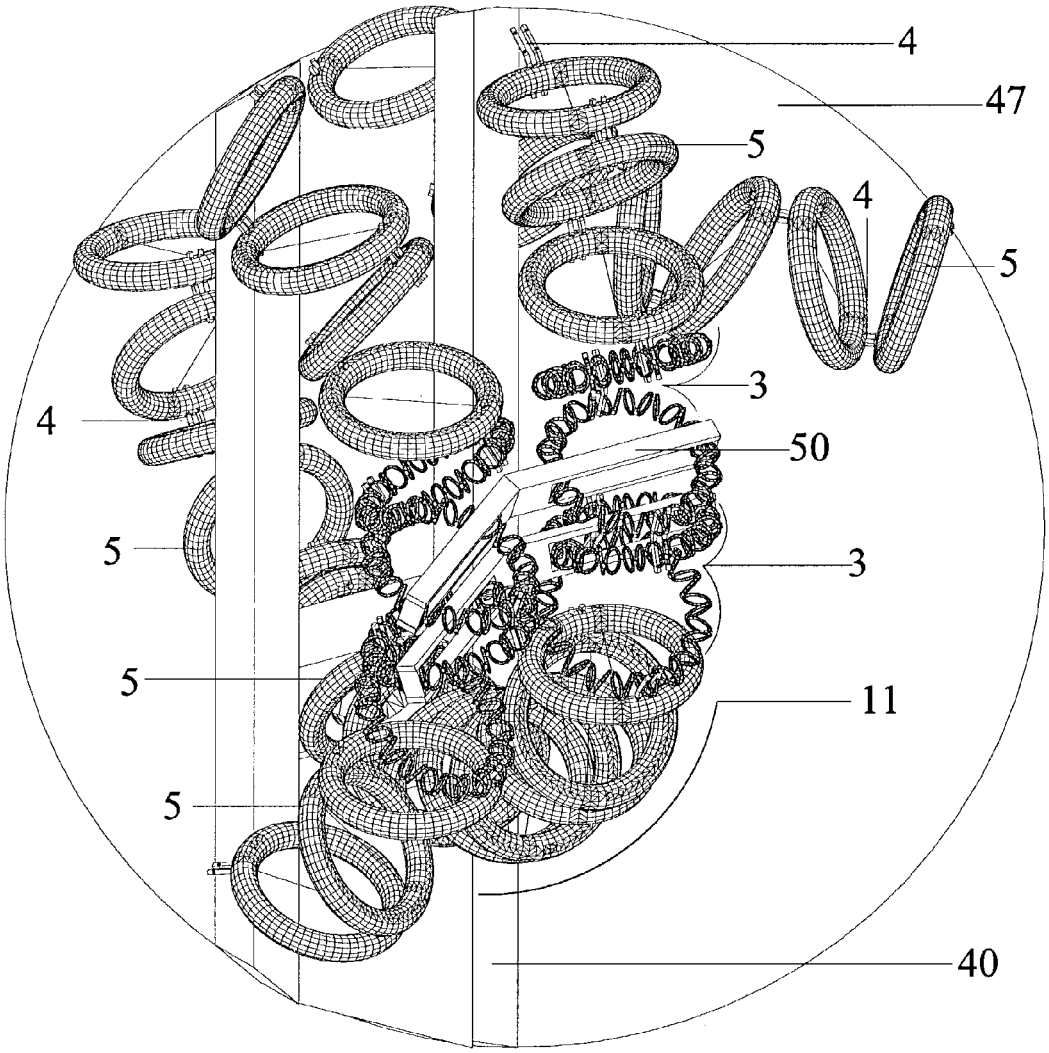
FIG. 49 is an enlarged oblique view of the outlined region shown in FIG. 48.

The process of construction of second-and-higher-level frameworks with lower-level frameworks using yoke-connectors is demonstrated in FIGS. 41–49. FIGS. 41–42 show a fourth-level toroidal framework 36 formed by acute-angular connection of third-level toroidal frameworks 33 (reprsented schematically as toroids 35) using yoke-connectors 34 of the type shown in FIG. 1, and indicates a section 37 that is enlarged in FIGS. 43–44. FIGS. 43–44 show the third-level toroidal frameworks 33 and the yoke-connectors 34 in the section 37, and further reveal the second-level framework 11 (from FIG. 1) structure of the toroidal elements (shown in FIG. 45 in schematic representation 42) into which the yoke-connectors 34 are inserted. The construction of the third-level framework 33 in FIGS. 45–46 shows the arms 40 of the yoke-connectors 34 (from FIGS. 43–44) yoking the second-level frameworks 11, which are also shown in schematic representation as toroids 42 connected by connectors 50 of the type shown in FIG. 1 to form the third-level framework 33, and indicates a section 43 that is enlarged in FIGS. 47–48. Section 43 as enlarged in FIGS. 47–48 shows the second-level toroidat frameworks 11 and the yoke-connectors 50 connecting the second-level frameworks 11. FIG. 48 also shows the construction of the second-level frameworks 11 with acute-angularly connected 4 (as in FIG. 1) first-level frameworks 3 (shown in FIGS. 1–3) and reveals the first-level framework 3 structure in the outlined section 47. Section 47 as enlarged in FIG. 49 shows the first-level frameworks 3 (and in schematic representation 5 connected by yoke-connectors 4 to form the second-level frameworks 11), into which are inserted yoke-connectors 50, as shown in FIGS. 37–40, for acute-anaular connection of the second-level frameworks 11 to form third-level frameworks (33 as shown in FIGS. 45–46).

The system of connection of the toroidal frameworks using yoke-connectors varies with the operations to be performed and the number of steps involved according to the embodiment of the invention required for the application, from merely inserting the yoke-connector into the framework, in the case of the embodiment shown in FIGS. 23–27, to fabricating the yoke-connector about the fundamental toroidal elements of a first-level framework, in the case of the embodiment shown in FIGS. 4–8. For symmetry considerations the method of connection disclosed also includes the use of multiple yoke-connectors, usually two, for connection between two toroidal frameworks.

While the invention has been disclosed in connection with examples of toroidally shaped frameworks of toroidal elements, it will be understood that there is no intention to limit the connector, process, or system which is the invention to the particular toroidally shaped frameworks shown. This disclosure is intended to cover not only the connector and the application thereof, but also the various alternative and equivalent constructions included within the spirit and scope of the appended claims.

What I claim as my invention is:

1. Connection of toroidal frameworks of toroidal elements for constructing larger toroidal frameworks comprising:

(a) at least two toroidally shaped frameworks comprised of acute-angularly connected toroidal elements, wherein said toroidal elements are: (1) fundamental toroidal elements; or, (2) toroidally shaped frameworks; and (b) a device for connecting said at least two toroidal frameworks comprising at least one arm of sufficient length to span at least one of said toroidal elements in each of said toroidal frameworks, said at least one arm further comprising:

(1) at least one base, and (2) at least one lug attached to said at least one base with at least one surface which engages at least one of said toroidal elements on opposite sides of said at least one of said toroidal elements, said at least one arm from each of said toroidal frameworks being joined in a joint region.

2. The connection of toroidal frameworks of claim 1, wherein said at least one arm is integrated with at least one of said toroidal frameworks which is a first-level framework.

3. The connection of toroidal frameworks of claim 1, wherein a torque on said at least one of said toroidal elements about its axis occurs when a force is applied to one end of said at least one arm of said device in a plane perpendicular to said axis and perpendicular to said at least one arm.

4. The connection of toroidal frameworks of claim 1, wherein said at least one lug of said device is formed to the shape of said at least one toroidal element.

5. The connection of toroidal frameworks of claim 1, wherein a side-retainer is attached to each of said at least one lug of said device.

6. The connection of toroidal frameworks of claim 1 wherein said at least one lug of said device has at least one surface engaged with the interior of a fundamental toroidal element.

7. The connection of toroidal frameworks of claim 1, wherein said at least one lug of said device has at least one surface engaged with at least one toroidal element of one of said toroidal frameworks.

8. The connection of toroidal frameworks of claim 1, wherein the lugs of said device are press-blocks.

9. The connection of toroidal frameworks of claim 1, wherein the lugs of said device are integrally formed with said at least one base.

10. The connection of toroidal frameworks of claim 1, with said at least one arm of said device further comprising a second base of sufficient length to span said at least one of said toroidal elements in each of the toroidal frameworks.

11. The connection of toroidal frameworks of claim 1, further comprising an arm which forms a yoke about said at least one of said toroidal elements.

12. The connection of toroidal frameworks of claim 1, wherein said at least two toroidal frameworks are angularly connected to each other.

13. The connection of toroidal frameworks of claim 1, wherein each of said arms of said device is rigidly joined to another of said arms within the joint region.

14. The connection of toroidal frameworks of claim 1 wherein each of said arms of said device is adjustably joined to another of said arms within the joint region so that the angle between said toroidal frameworks is adjustable.

15. Connection of toroidal frameworks of toroidal elements for constructing larger toroidal frameworks comprising:

(a) at least two toroidally shaped frameworks comprised of acute-angularly connected fundamental toroidal elements; and (b) a device for connecting said at least two toroidal frameworks comprising one or more arms of sufficient length to span at least one of said fundamental toroidal elements in each of said toroidal frameworks, said one or more arms further comprising:

(1) at least one base, and (2) at least one lug attached to said at least on base with at least one surface which engages at least one of said fundamental toroidal elements on opposite sides of said at least one of said fundamental toroidal elements, at least one of said one or more arms from each of said fundamental toroidal elements being joined in a joint region.

16. The connection of toroidal frameworks of claim 15, wherein each of said arms is adjustably joined to another of said arms within the joint region so that the angle between said toroidal frameworks is adjustable.

17. Connection of toroidal frameworks of toroidal elements for constructing larger toroidal frameworks comprising:

(a) at least two toroidally shaped frameworks comprised of toroidal elements which are acute-angularly connected toroidal frameworks; and (b) a device for connecting said at least two toroidal frameworks comprising one or more arms of sufficient length to span one or more of said toroidal elements in each of said at least two toroidal frameworks, said one or more arms further comprising:

(1) one or more bases, and (2) one or more lugs attached to said one or more bases with one or more suffaces which engage one or more of said toroidal elements on opposite sides of said one or more toroidal elements, at least one of said one or more arms from each of said toroidal frameworks being joined in a joint region.

18. Connection of higher-level toroidally shaped frameworks constructed with acute-angularly connected lower-level toroidal frameworks, comprising:

(a) at least two higher-level toroidally shaped frameworks comprised of acute-angularly connected lower-level toroidal frameworks; and (b) one or more yoke-connectors applied to one or more lower-level toroidal frameworks in each of the higher-level toroidal frameworks, said one or more yoke-connectors from each of said lower-level toroidal frameworks being joined in a joint region.

19. The connection of higher-level toroidally shaped frameworks of claim 18, wherein the connection is applied repeatedly in successive steps for formation of yet higher-level toroidally shaped frameworks.

20. The connection of higher-level toroidally shaped frameworks of claim 19, wherein the application of said yoke-connectors is by insertion of the lugs thereof between the acute-angularly connected toroidal elements of the lower-level toroidal frameworks.

* * * * *